US009481987B2

(12) United States Patent
Salzer

(10) Patent No.: US 9,481,987 B2
(45) Date of Patent: Nov. 1, 2016

(54) DEVICES, SYSTEMS, AND METHODS FOR AUTOMATED DRAIN JETTING

(71) Applicant: Ray Salzer, Fife, WA (US)

(72) Inventor: Ray Salzer, Fife, WA (US)

( * ) Notice: Subject to any disclaimer, the term of this patent is extended or adjusted under 35 U.S.C. 154(b) by 164 days.

(21) Appl. No.: 14/244,794

(22) Filed: Apr. 3, 2014

(65) Prior Publication Data

US 2014/0304901 A1 Oct. 16, 2014

Related U.S. Application Data

(60) Provisional application No. 61/812,557, filed on Apr. 16, 2013.

(51) Int. Cl.
*E03D 9/00* (2006.01)
*E03C 1/304* (2006.01)

(52) U.S. Cl.
CPC ..... *E03C 1/304* (2013.01); *E03D 9/00* (2013.01); *Y10T 29/494* (2015.01)

(58) Field of Classification Search
CPC ..... E03C 1/306
USPC ..... 4/255.01–255.12
See application file for complete search history.

(56) References Cited

U.S. PATENT DOCUMENTS

2004/0044170 A1* 3/2004 DeBruin ..... B01D 19/0042 528/272
2010/0086445 A1* 4/2010 Sims ..... B01F 1/0027 422/106
2011/0023485 A1* 2/2011 Schubert ..... C02F 1/048 60/648
2011/0089122 A1* 4/2011 Smith ..... B01D 33/04 210/774
2011/0265474 A1* 11/2011 Schubert ..... C02F 1/048 60/641.9
2012/0097201 A1* 4/2012 Field ..... A47L 11/302 134/58 R

* cited by examiner

*Primary Examiner* — Lori Baker
(74) *Attorney, Agent, or Firm* — Seed IP Law Group LLP

(57) ABSTRACT

Devices, systems, and methods for clearing drain lines are disclosed. A device comprising a body with an internal cavity extending between a nozzle aperture and a coupling section, the body including a base configured to couple the body to a drain line. A nozzle body disposed within the internal cavity. A bias spring configured to retain the nozzle body in a retracted position, the nozzle body configured to extend into the drain line when the nozzle body is pressurized and the nozzle body including a nozzle configured to expel fluid in a direction of flow of the drain line.

4 Claims, 19 Drawing Sheets

DEVICES, SYSTEMS, AND METHODS FOR AUTOMATED DRAIN JETTING

BACKGROUND

1. Technical Field

The present disclosure relates to systems, devices, and methods for cleaning and maintaining pipes and drains, and more particularly, to automated inline jetting systems that preventatively clean pipes and clear them of obstructions.

2. Background of the Invention

Restaurants, coffee shops, pet grooming and boarding shops, and any other facility that washes water and other material down their drains will eventually suffer a backup caused by a clog. In some cases, a clogged drain prevents the use of sinks or drains that are necessary for the facility to operate. When this happens, the facility must stop their operation and shut down while a plumber drives over and works to clear the clog.

Even when the clogged drains do not cause a facility to shut down, a stopped up sink or drain may limit productivity, plant capacity, or cause a safety hazard until a plumber clears the clog. Whether the clog stops all operations or merely limits productivity, the business must have a plumber come out to their facility to clear the clog.

When a plumber clears a clogged drain, they often use a portable jetting system. A portable jetting system may include a water nozzle on the end of a long hose, or snake. A plumber typically accesses a facility's waste water system through a drain or a clean-out port. The plumber will feed the snake through the drain until it reaches the clog. Once the snake reaches the clog, the plumber forces water through the nozzle at the head of the snake line. The water then breaks up the clog, flushes the debris through the drain system, and clears the pipes.

As anyone who has ever called a plumber knows, high quality plumbing services are expensive. Some of this cost is due to the fact that skilled plumbers must own and maintain a large variety of tools and equipment so that they can quickly diagnose and fix any plumbing problem they may encounter. This high expense is compounded by the fact that the average restaurant or coffee shop needs to call a plumber to clear a clogged drain or sink 1.5 times each month, 18 times per year. This plumbing expense is a drain on a business' resources. To add to a business owner's frustrations, clogged drains occur at unpredictable intervals.

In theory, clogged drains may be prevented by regularly clearing debris from sinks and drain lines before it builds up enough to cause a clog. Unfortunately, no practical system exists to clean pipes and drain lines to prevent debris from clogging wastewater systems.

What restaurants, coffee shops, pet boarders and groomers, and other businesses need is a reliable drain jetting system that is simple to operate. Business should be able to install the system with new construction or retrofit the system into existing plumbing systems. The system should also automatically and preventatively clear the pipes and drain lines of a wastewater system to substantially decrease the likelihood of debris building up in the system and causing a full-blown clog.

BRIEF SUMMARY

The present disclosure is directed towards devices, systems, and methods for clearing drain lines. A device for clearing drain lines may be summarized as including a body with an internal cavity extending between a nozzle aperture and a coupling section, the body including a base configured to couple the body to a drain line, a nozzle body disposed within the internal cavity, and a bias spring configured to retain the nozzle body in a retracted position, the nozzle body configured to extend into the drain line when the nozzle body is pressurized, and the nozzle body including a nozzle configured to expel fluid in a direction of flow of the drain line.

A device for cleaning a drain line of a floor sink may be summarized as including a body with an internal cavity extending between a base and nozzle head. The body including a base configured to couple the body to a floor sink and a segment extending at least partially between the base and the nozzle head. The nozzle head including an externally facing sealing surface operably configured to inhibit water flow between then drain line and an interior of the floor sink. The nozzle disposed within at least a portion of the nozzle head. The nozzle including a nozzle orifice operably configured to expel water into a drain.

A device for clearing a drain line may also be summarized as including a body with an internal cavity extending between a nozzle aperture and an inlet. The body including a base configured to couple the body to a drain line, and an adapter, a slip joint ring, and a slip joint washer, each of which at least partially surrounds an external circumference of the body. The adapter is configured to engage an inlet of a tee pipe fitting. The slip joint washer and slip joint ring are configured to engage with the adapter and the exterior of the nozzle body. The adapter, the slip joint ring, and the slip joint washer configured such that engaging the slip joint ring with the adapter retains the device in the tee pipe fitting. The device also including a nozzle body disposed within the internal cavity and a bias spring configured to retain the nozzle body in a retracted position. The nozzle body is configured to extend into the drain line when the nozzle body is pressurized and includes a nozzle configured to expel fluid in a direction of flow of the drain line.

A system for clearing a wastewater system of debris may be summarized as including a first drain line jet configured to be mounted to a horizontal drain line. The first drain line jet including a body with an internal cavity extending between a nozzle aperture and a coupling section and the body including a base configured to couple the body to a drain line. A first water line is coupled to a first control valve and the first drain line jet such that the first control valve is in fluid communication with the first drain line jet. The system also includes a system controller in electrical communication with the first control valve and configured to activate the first control valve for a predetermined period of time, a nozzle body disposed within the internal cavity, and a bias spring configured to retain the nozzle body in a retracted position. The nozzle body configured to extend into the drain line when the nozzle body is pressurized and the nozzle body including a nozzle configured to expel fluid in a direction of flow of the drain line.

A method of installing a drain jet system may be summarized as including installing a first jet onto a sink drain line, installing a second jet into a clean-out tee, coupling the first jet to a first control valve via a first water supply line, coupling the second jet to a second control valve via a second water supply line, and coupling a control system to the first and second control valves.

A method of installing a drain jet may be summarized as including mounting a base of a drain jet to a drain line, coupling a water supply line to a jet inlet, coupling a water supply line to a control valve, and connecting a controller to the control valve.

A method of cleaning a drain line may be summarized as including activating a first drain line jet, activating a second drain line jet, and activating a cleanout jet.

A method of cleaning a drain of a floor sink may be summarized as including opening a control valve to couple a pressurized water supply in fluid communication with a floor drain jet, extending a jet head towards the drain of the floor sink, at least partially sealing the drain of the floor sink by bringing a sealing member of the floor drain jet in contact with the drain of the floor sink, and expelling fluid from a nozzle of the floor drain jet in a direction of flow of the drain of the floor sink such that debris is forced down the drain line.

DETAILED DESCRIPTION

Figure 1:
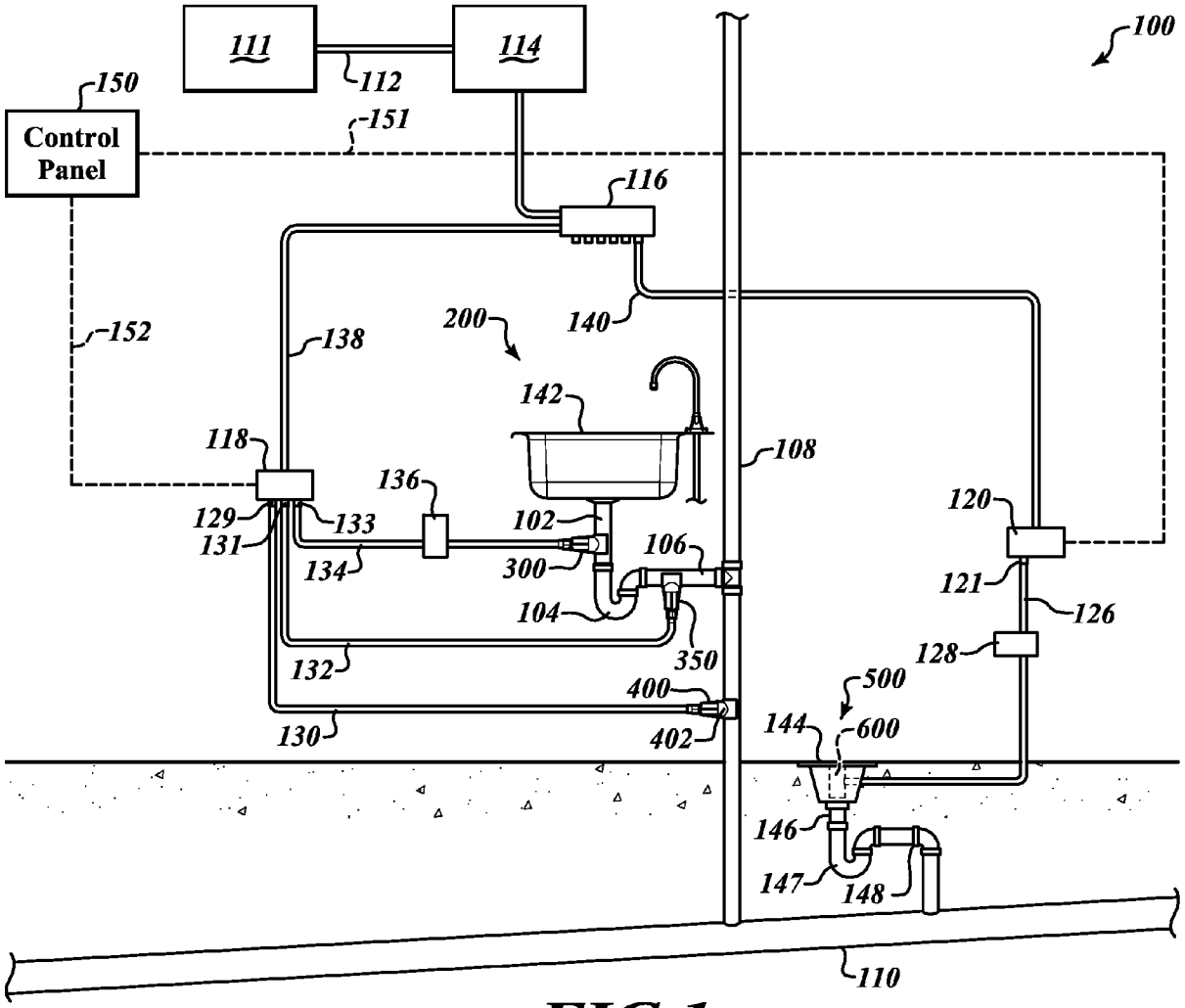
FIG. 1 is a diagram schematically showing an embodiment of a drain jetting system installed in a wastewater system.

FIG. 1 shows an embodiment of a drain jetting system 100 installed on a wastewater plumbing system. The plumbing system may be a retail, restaurant, industrial, commercial, or other type of plumbing system. A drain jetting system may be installed during construction of the wastewater plumbing system or retrofitted onto an existing wastewater plumbing system. The plumbing system shown in FIG. 1 includes a sink 142 connected to a main wastewater drain line 110 through a vertical drain line 102, a p-trap 104, horizontal drain line 106, and a vent line 108. The plumbing system also includes a floor sink 144 connected to the main wastewater drain line 110 through a vertical drainpipe 146, a p-trap 147, and a horizontal drain line 148. Drain lines and drain pipes may be of any practical diameter. In some embodiments, the drain lines may be between approximately 1.5 and 4 inches in diameter.

In a typical plumbing system, a drainpipe is usually a vertically arranged pipe that connects to the outlet of a sink, tub, or other piece of plumbing equipment. A drainpipe typically connects to the inlet of a p-trap. A p-trap is a plumbing fixture that traps debris that has drained from the sink and helps prevent the debris from forming a clog further down the plumbing system. P-traps also provide a water seal that stops sewer gases from passing back up the system and into a home or business through the sink drain.

The outlet of a p-trap typically connects to a horizontal drain line that then connects to a vent line or eventually to a main effluent or wastewater line. A main effluent line typically connects a facility's wastewater system to a sewer or septic system.

The drain jetting system 100 includes a counter sink jetting system 200 and a floor sink jetting system 500. The counter sink jetting system 200 helps keep a sink's 142 drainpipes clear of clogs while the floor sink jetting system 500 keeps the floor sink's 144 drainpipes clear.

A counter sink jetting system may include one or more jets. For example, the illustrated counter sink jetting system 200 includes three jets 300, 350, 400. The p-trap jet 300 flushes water through the p-trap and clears debris that may have built up in the p-trap. The horizontal drain jet 350 flushes water through the horizontal drain line 106 and clears debris in the horizontal drain at the outlet of the p-trap, plus any debris that was flushed out of the p-trap by the p-trap jet. The cleanout jet 400 flushes water from a drain cleanout connector 402 through the drain or vent line 108 and into the main wastewater drain line 110. The cleanout jet 400 clears debris that may have built up in the drain or vent line 108 along with debris flushed down the drain by the horizontal drain jet 350 and the p-trap jet 300.

A floor sink jetting system may also include one or more jets. For example, the illustrated floor sink jetting system 500 includes a floor sink jet 600 and may include additional p-trap, horizontal, and cleanout jets, not shown in FIG. 1. As discussed in more detail below, the floor sink jet 600 includes a telescoping nozzle and seal. Most of the time, when the floor sink jet 600 is off, the nozzle and seal are in a retracted position. When the floor sink jet 600 is on, the nozzle and seal extend from a retracted position to an extended position. In the extended position, the jet 600 seals the drain and directs its nozzle into the floor sink's 144 drain. With the jet 600 in the extended position, the jet 600 flushes the floor sink's 144 drain of debris. If the floor sink jetting system 500 includes p-trap, horizontal, and cleanout jets, then the system 100 would also activate those jets in a manner similar to that of the corresponding jets in the counter sink jetting system 200 described above.

The jets 300, 350, 400, 600 receive their water supply from the building's potable water system 111. In one embodiment of a jetting system, the potable water system 111 supplies jetting water to an expansion tank 114 through a supply line 112. The expansion tank 114 then supplies water to the jetting system's 100 various jets 300, 350, 400, 600 through a series of supply lines 138, 140, control valve assemblies 118, 120, and then through more supply lines 130, 132, 134, 126. In some embodiments the water also flows through a p-fill canister 136, 128 before entering the jets, 300, 350, 400, 600. The p-fill canister may fill up with water of fluid during the jetting process when an associated p-trap jet is activated, such as p-trap jet 300 and associated p-fill canister 136. When the jet stops, the water in the p-fill canister drains into an associated p-trap to ensure that the trap is filled and to prevent sewer gasses from traveling up an open p-trap and into the building.

An expansion tank helps dampen pressure fluctuations in the potable water system. The jetting system works by flushing a large amount of water through the jets and down the pipes over a relatively short amount of time. The high flow demanded by the jets may cause pressure fluctuations, sometimes called water hammer, in some facilities' water systems. An expansion tank serves as a local reservoir for the jetting system and helps insulate the building's main water system from the jets.

In some embodiments, the outlet of an expansion tank may supply water to a manifold. In the jetting system 100, the expansion tank 114 supplies water to a manifold 116. The manifold 116 distributes water downstream to the control valve assemblies 118, 120.

Control valve assemblies manually or automatically control water flow to the jets they control. Control valve assemblies may also include a manifold. For example, the illustrated control valve 118 includes a manifold that distributes water to three jets 300, 350, 400. The control valve assembly 118 may also include three control valves 129, 131, 133 that connect to the three jets 300, 350, 400, through supply lines 130, 132, 134. The supply lines may include PVC or other types of piping or flexible piping or hoses.

Control valves may include, for example, solenoid valves, motorized valves, or pneumatic valves.

In some embodiments, a control valve assembly may not include a manifold. For example, the illustrated control valve assembly 120 only controls water flow to a single jet 600, therefore it may include a single control valve 121, but does not necessarily include a manifold.

In some embodiments, an operator may manually actuate one or more control valves in a jetting system. In a preferred embodiment, a controller actuates the control valves. A controller 150 controls the control valves 129, 131, 133, 121 and therefore the flow of water to the jets 300, 350, 400, 600 of jetting system 100.

Figure 15:
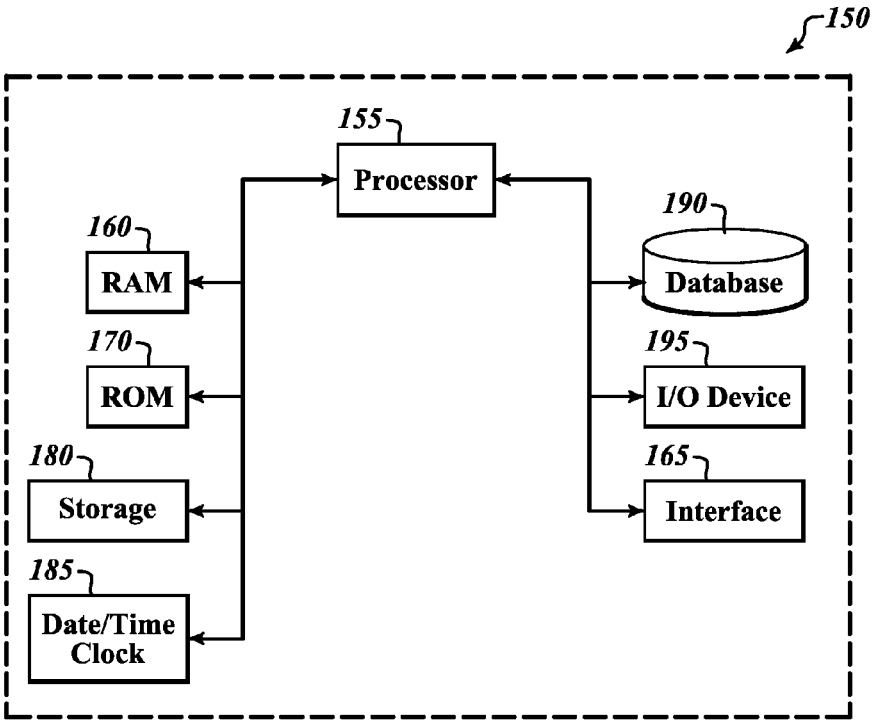
FIG. 15 is a diagram of an embodiment of a controller.

For example, as illustrated in FIG. 15, a controller 150 may include one or more hardware and/or software components configured to execute software programs, such as software for storing, processing, and analyzing data. For example, system 150 may include one or more hardware components such as, for example, processor 155, a random access memory (RAM) module 160, a read-only memory (ROM) module 170, a storage system 180, a database 190, one or more input/output (I/O) devices 195, and an interface 165. Alternatively and/or additionally, system 150 may include one or more software components such as, for example, a computer-readable medium including computer-executable instructions for performing methods consistent with disclosed embodiments. It is contemplated that one or more of the hardware components listed above may be implemented using software. For example, storage 180 may include a software partition associated with one or more other hardware components of system 150. System 150 may include additional, fewer, and/or different components than those listed above. It is understood that the components listed above are exemplary only and not intended to be limiting.

Processor 155 may include one or more processors, which may be configured to execute instructions and process data to perform one or more functions associated with system 150. As illustrated in FIG. 15, processor 155 may be communicatively coupled to RAM 160, ROM 170, storage 180, database 190, I/O devices 195, and interface 165. Processor 155 may be configured to execute sequences of computer program instructions to perform various processes, which will be described in more detail below. The computer program instructions may be loaded into RAM 160 for execution by processor 155.

RAM 160 and ROM 170 may each include one or more devices for storing information associated with an operation of system 150 and/or processor 155. For example, ROM 170 may include a memory device configured to access and store information associated with system 150, including information for identifying, initializing, and/or monitoring the operation of one or more components and subsystems of system 150. RAM 160 may include a memory device for storing data associated with one or more operations of processor 155. For example, ROM 170 may load instructions into RAM 160 for execution by processor 155.

Storage 180 may include any type of mass storage device configured to store information that processor 155 may use to perform processes consistent with the disclosed embodiments. For example, storage 180 may include one or more magnetic and/or optical disk devices, such as hard drives, CD-ROMs, DVD-ROMs, or any other type of mass media device, such as flash memory.

Date/Time Clock 185 may include a real-time clock or other means of tracking the date or time and providing date or time information to other parts of the controller 150.

Database 190 may include one or more software and/or hardware components that cooperate to store, organize, sort, filter, and/or arrange data used by system 150 and/or processor 155. For example, database 190 may include dates, days, and times at which the system 150 activates a jetting system. Alternatively, database 190 may store additional and/or different information.

I/O devices 195 may include one or more components configured to communicate information with a user associated with system 150. For example, I/O devices 195 may include a console with an integrated keyboard and mouse to allow a user to input parameters associated with system 150. I/O devices 195 may also include a display including a text or graphical user interface (GUI) for outputting information on a monitor or screen. I/O devices 195 may also include peripheral devices, such as a user-accessible disk drive (e.g., a USB port, a floppy, CD-ROM, or DVD-ROM drive, etc.) to allow a user to input data stored on a portable media device, or any other suitable type of interface device.

Interface 165 may include one or more components configured to transmit and receive data via a communication network, such as the Internet, a local area network, a workstation peer-to-peer network, a direct link network, a wireless network, and/or any other suitable communication platform. For example, interface 165 may include one or more modulators, demodulators, multiplexers, demultiplexers, network communication devices, wireless devices, antennas, modems, and any other type of device configured to enable data communication via a communication network. Interface 165 may include a Bluetooth interface, Wi-Fi, or electric wiring such as low voltage wiring.

In some embodiments, the system 150 may include a programmable logic controller (PLC), for example a 12-volt or 24-volt PLC.

The controller 150 may be in electronic communication with each of the control valve assemblies 118, 120 and control valves 129, 131, 133, 121. The controller 150 may communicate with the valves through electronic control lines 152, 151. In some embodiments, the control valves may be pneumatic, and therefore a controller may communicate with control valves via fluid communication through tubes or pipes. In some embodiments, a controller may communicate to the control valves in other ways, including fiber optic or wireless communication including Wi-Fi, Bluetooth, mesh communication, ZigBee, cellular, and other methods.

Figure 2:
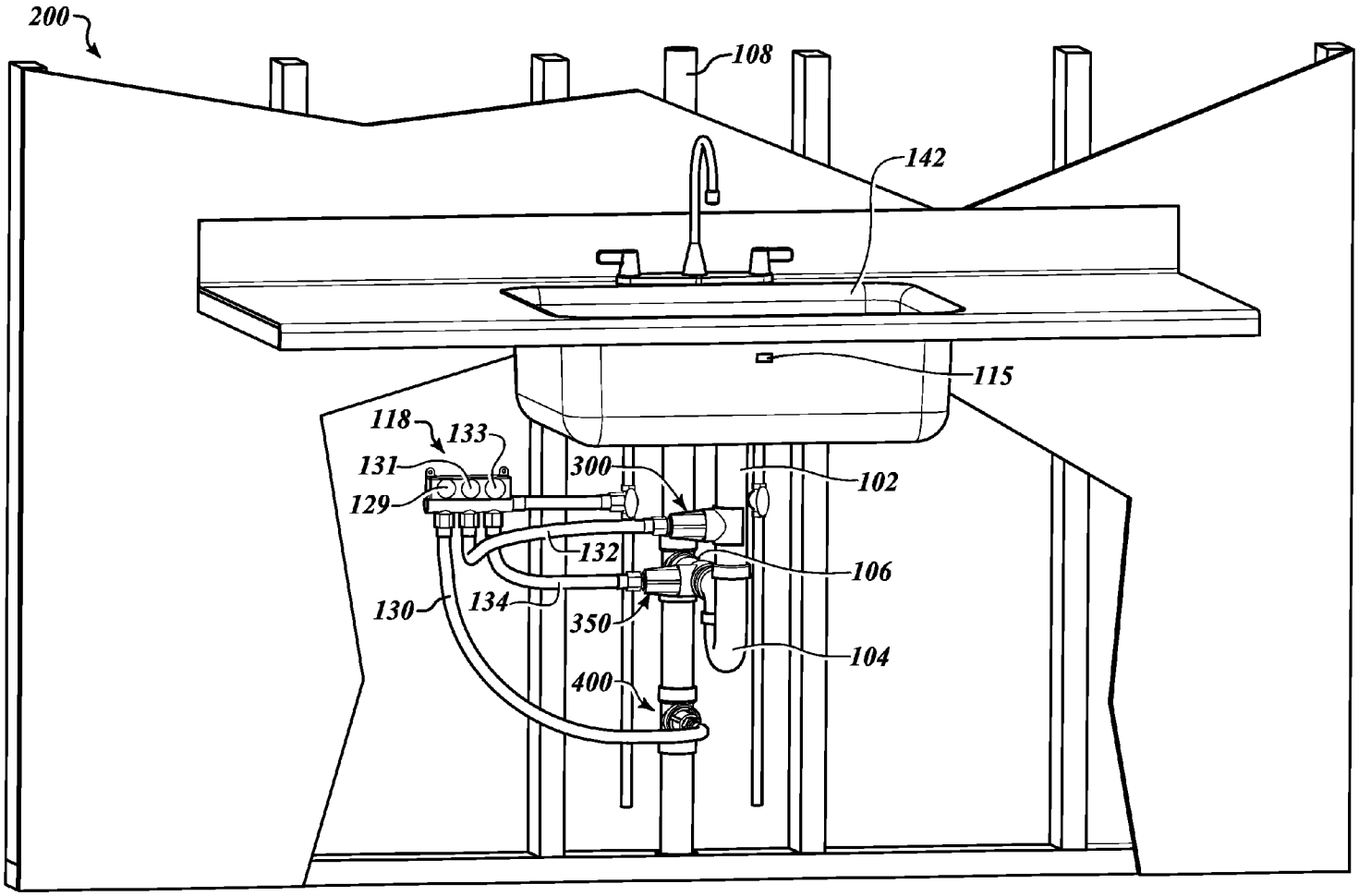
FIG. 2 is a perspective view of an embodiment of a drain jetting system for cleaning the drain lines of a sink.

FIG. 2 shows an embodiment of a counter sink jetting system 200 installed onto a counter sink 142. The sink 142 drains through the vertical drain line 102, the p-trap 104, the horizontal drain line 106, and into the vent line 108. The jet 300 is positioned between the drain line 102 and the p-trap 104. When activated, the jet 300 forces water and debris down and through the p-trap 104 and into the horizontal drain line 106. The jet 350 may then activate and force water and debris through the horizontal drain line 106 and into the vent line 108.

At this point, gravity may force the debris down the vent line 108, but gravity is not always adequate to keep the vent line clog free and clear of debris. Therefore, a clean-out jet 400 may activate and force water and debris through the vent line 108 and into the main wastewater drain line 110 (not shown in FIG. 2, see FIG. 1).

In the embodiment shown in FIG. 2, the p-trap jet 300 and horizontal jet 350 are of similar construction and operation, except that the p-trap jet is vertically oriented, while the horizontal jet 350 is horizontally oriented. In some embodiments, the p-trap jet 300 and horizontal jet 350 may operate differently and have differing constructions.

Figure 3:
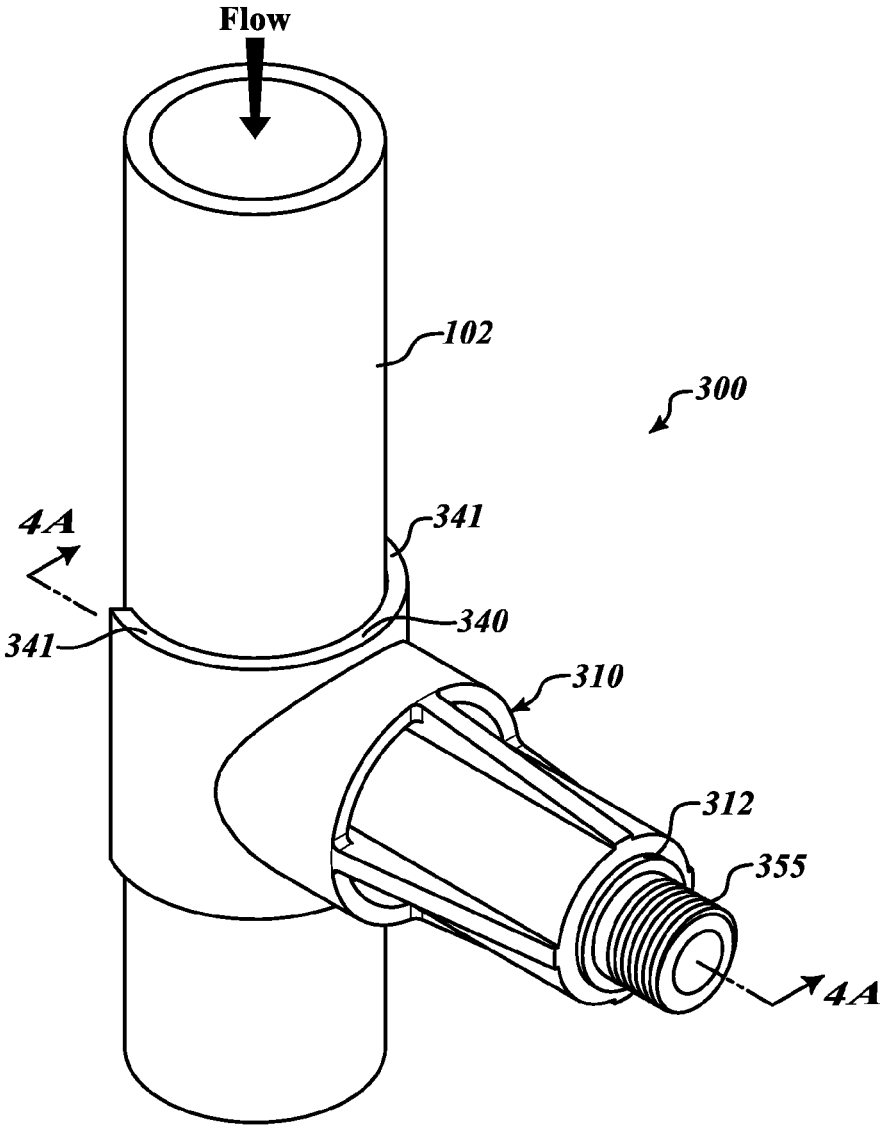
FIG. 3 is an isometric view of an embodiment of a jetting device.

FIG. 3 shows the exterior of an embodiment of a p-trap jet 300. The p-trap jet 300 includes a main body (sometimes referred to as an encasement or outer housing) 310, a pipe coupler or base 340, and a water supply inlet 312. The pipe coupler 340 may extend from the body 310 and couples or attaches the p-trap jet 300 to a drainpipe, for example the vertical counter sink drain line 102. The coupler 340 may include an arm, for example arms 341, which, together, extend at least partially, around a drain line. In some embodiments, an arm may be configured to extend more than halfway around a drain line. By extending more than halfway around the drain line 102, the arms 341 can grab the drain line 102 and resist removal of the jet 300. In addition, an adhesive, epoxy, or other bonding agent can affix the jet 300 to the drain line 102, for example, by applying the bonding agent to the mating surfaces of the drain line 102 and pipe coupler 340. In some embodiments, the pipe coupler may be a clamp.

The p-trap jet 300 also includes an inlet 312. The inlet 312 may also facilitate coupling the jet 300 to a jet fluid supply line. For example, inlet 312 may include threads that allow it to accept a pipefitting adapter 355. The pipefitting adapter 355 allows the jet to accept standard pipefittings and makes installation easier.

Figure 4A:
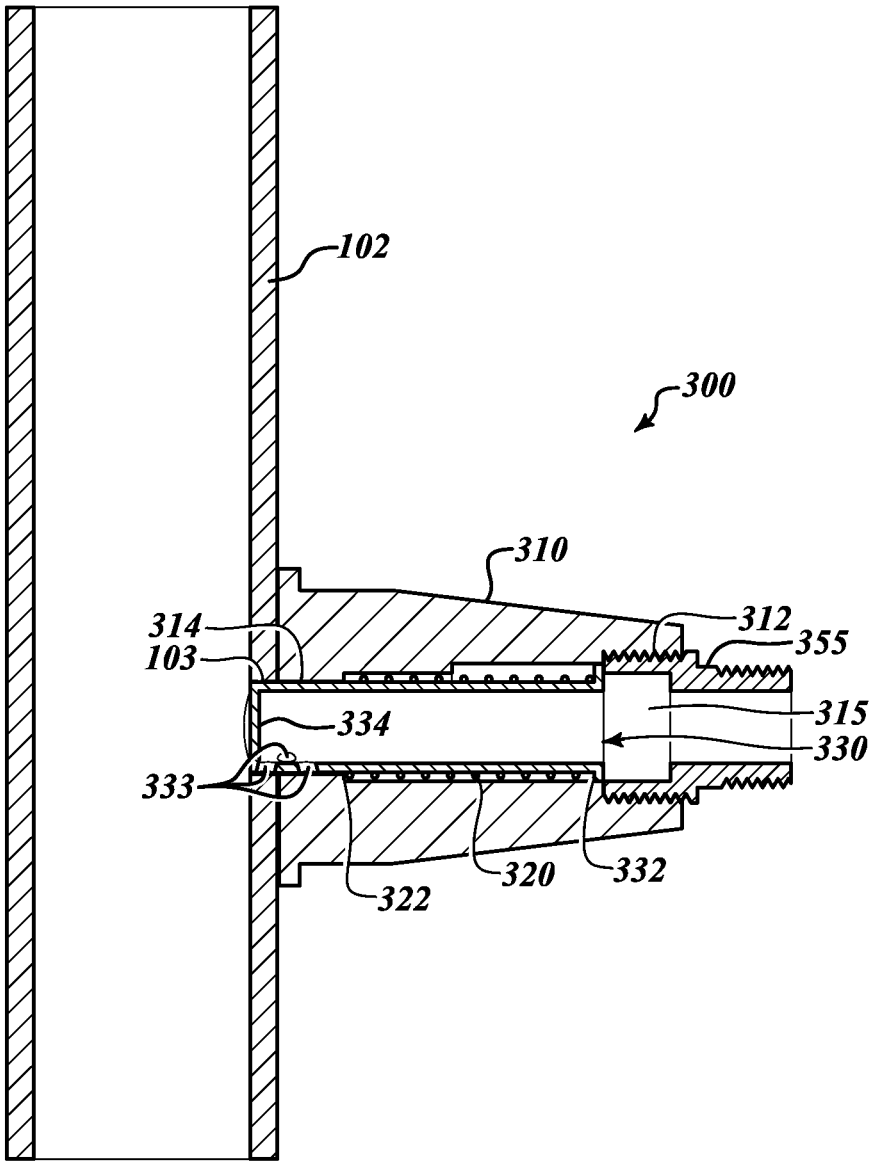
FIG. 4A is a cross-sectional view of the jetting device of FIG. 3 with a nozzle body in a retracted position.

FIG. 4A shows a cross section of the jet 300 of FIG. 3. As shown, the body 310 may include an interior cavity 315 that extends between a nozzle aperture 314 at a drain line end of the body 310 and an inlet 312 at a coupling location of the body 310. An interior cavity may also be referred to as a pilot hole or shaft. The inlet 312 may receive an adapter 355 for connecting to a plumbing system or water supply line. As shown in FIG. 4A, the adapter 355 includes threads and screws into the inlet 312. In some embodiments, the outer diameter of the adapter 355 may be larger than the outer diameter of a nozzle body 330, sometimes also referred to as a jet nozzle. In this way, the adapter 355 may retain the nozzle body 330 within the interior cavity 315 of the jet 300. The difference in diameters may also allow for easy inspection and repair of the jet 300 and its components. For example, in the embodiment of FIG. 4A, by removing the adapter 355, a repair person may also remove the nozzle body 330 and spring 320 and gain access to the interior cavity 315 of the jet 300.

The interior cavity 315 may house a nozzle or nozzle body 330 and spring 320. The illustrated spring 320 coils around the nozzle body 330. A first end of the spring pushes against the body 310 at a spring shoulder 322 and a second end of the spring pushes against a nozzle body flange 332. In this way, the spring 320 acts to keep the nozzle body 330 in a retracted position when the jet 300 is off. The spring 320 may be a stainless steal spring.

Figure 4B:
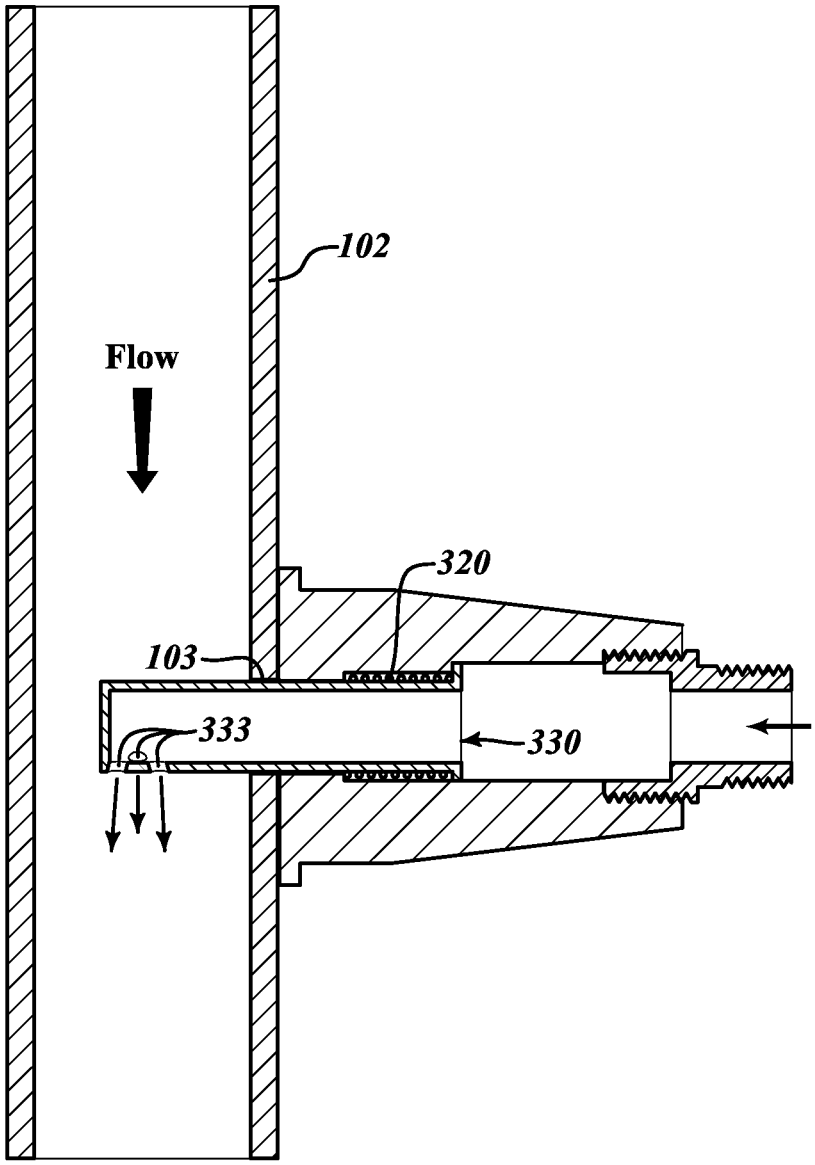
FIG. 4B is a cross-sectional view of the jetting device of FIG. 3 with the nozzle body in an extended position.

When the jet 300 is on, water pressure acts against an end of the nozzle 334. The water pressure against the end 334 overcomes the bias force of the spring 320 and causes the nozzle to pass through a jet aperture 103 and enter the drain line 102 as shown in FIG. 4B. When the nozzle body 330 is in the extended or jetting position as shown in FIG. 4B, nozzle jets 333 are exposed to the interior of the drain line 102 and oriented in the drainpipe's 102 direction of flow. With the nozzle jets 333 exposed, the water and/or other jetting fluid is expelled from the nozzle and acts to clear the drain line 102 of debris by forcing the debris further down the drain line.

Figure 5:
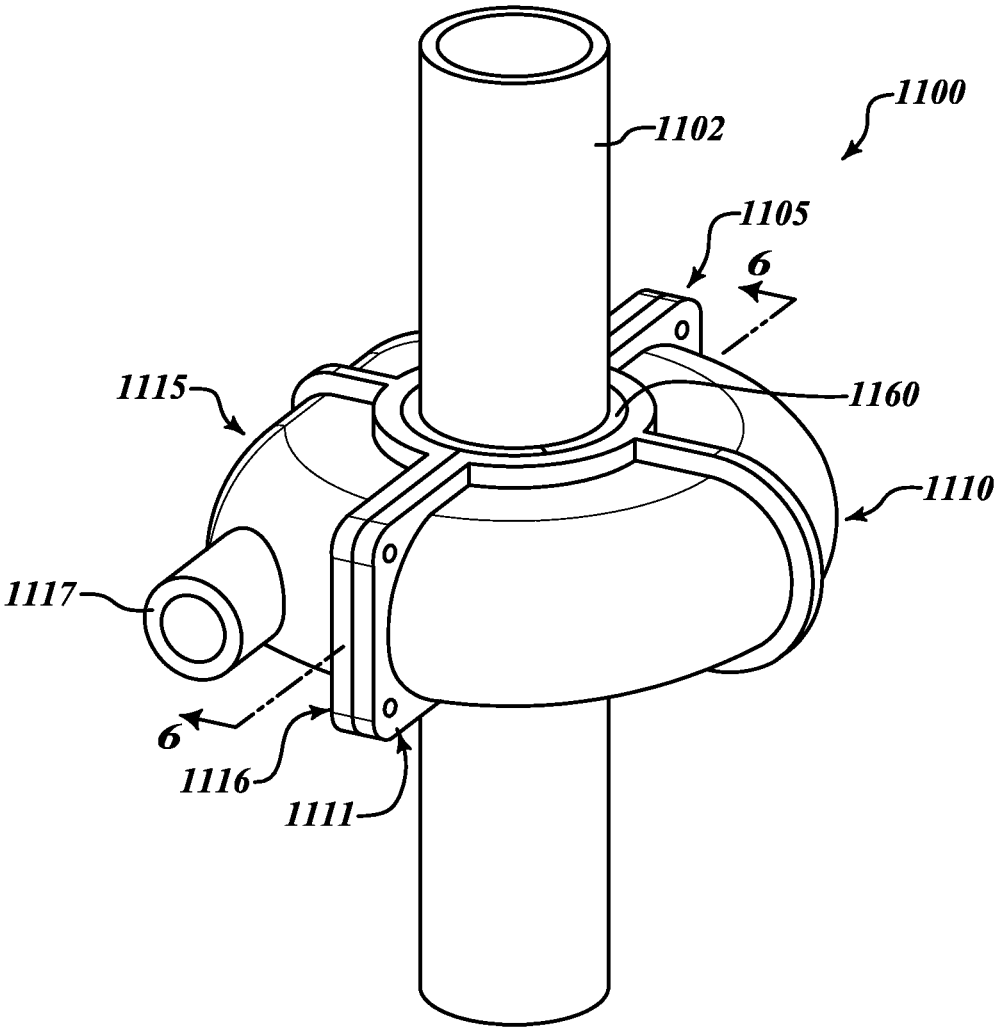
FIG. 5 is an isometric view of an embodiment of a jetting device.

Some larger drain lines may warrant the use of a jet with multiple nozzles. FIG. 5 depicts a multiple nozzle jet 1100. The jet 1100 includes an outer casing (sometimes referred to as an encasement or outer housing) 1105 that surrounds drain pipe 1102. The outer casing 1105 may include an inlet coupling 1117 that is configured to couple to a water supply line for supplying pressurized water to the nozzles (see FIG. 6) within the casing 1105. In some embodiments, the outer casing 1105 may include two case halves 1115, 1110 that couple together. In some embodiments, the case halves include flanges 1116, 1111 for coupling one half to the other.

Figure 6:
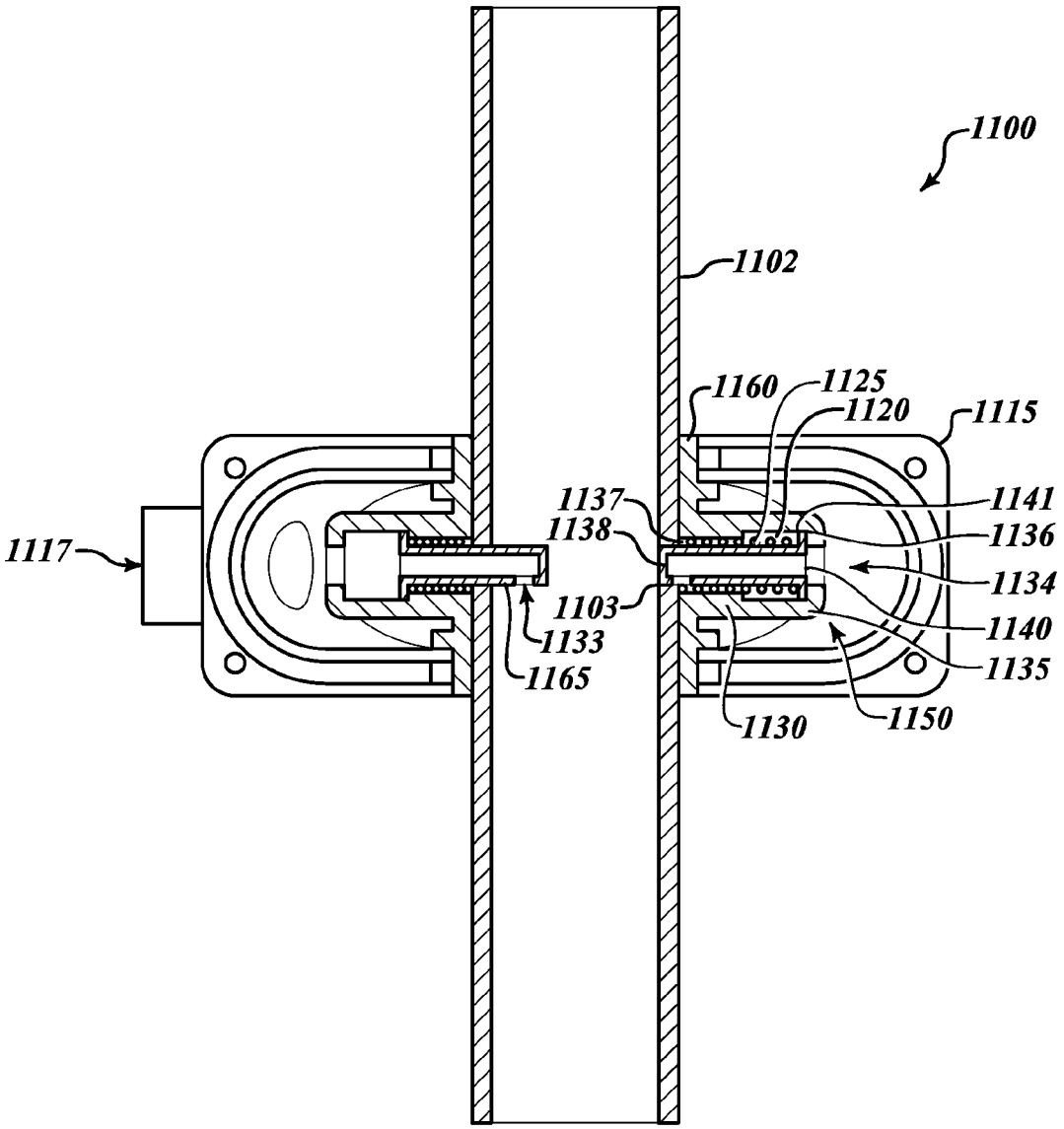
FIG. 6 is a cross-sectional view of the jetting device of FIG. 5.

FIG. 6 shows a cross sectional view of the jet 1100 of FIG. 5. The jet 1100 includes a first nozzle body 1140 in a retracted position and a second nozzle body 1165 in an extended position. Like the p-trap jet discussed above, a nozzle body is in the retracted position when it is off and in the extended position when it is on.

A nozzle assembly includes a number of parts. The pieces of a nozzle assembly will be discussed with reference to the embodiment of nozzle assembly 1150. Nozzle assembly 1150 includes a body 1130, a nozzle body 1140, and a retention device 1135. The body 1130 includes a sealing flange or base 1160. The sealing flange 1160 mates with a portion of the surface of the drain line 1102 and mitigates leaks between the drain pipe 1102 and the jet 1100. In some embodiments the sealing flange may include a gasket or a bonding agent to seal the surface of the drain line and the surface of the sealing flange 1160.

The body 1130 may also include an interior cavity 1120 extending between a location proximate to a surface of the drain line 1102 and a water inlet 1134. The interior cavity 1120 may house the nozzle body 1140 and a bias spring 1125. The bias spring 1125 coils around the nozzle body 1140. A first end of the spring pushes against the nozzle body flange 1141 and a second end of the spring pushes against a nozzle body shoulder 1137. In this way, the spring 1125 acts to keep the nozzle body 1140 in a retracted position when the jet 1100 is off.

When the jet 1100 is on, water pressure acts against an end of the nozzle 1138. The water pressure against the end 1138 overcomes the bias force of the spring 1125 and causes the nozzle to pass through jet aperture 1103 and enter the drain line 1102 as shown by nozzle body 1165. When a nozzle body is in the extended or jetting position, the nozzles, for example nozzles 1133, are exposed to the interior of the drain line 1102 and oriented in the drain line's 1102 direction of flow. With the nozzles exposed, the water or other jetting fluid is expelled from the nozzle and acts to clear the drain line 1102 of debris by forcing the debris further down the drain line.

The nozzle assembly 1150 also includes a retention device 1135 which retains the nozzle body 1140 within the interior cavity 1120. In some embodiments, the retention device 1135 retains the nozzle body 1140 by providing a shoulder 1136 with a diameter that is smaller than the diameter for the nozzle body 1140. In particular, the shoulder 1136 may have a diameter that is smaller than a nozzle body flange 1141. By this arrangement, when the nozzle body is biased in the off position, the flange 1141 may abut the shoulder 1136, which may retain the nozzle body 1140 within the interior cavity 1120.

Figure 7:
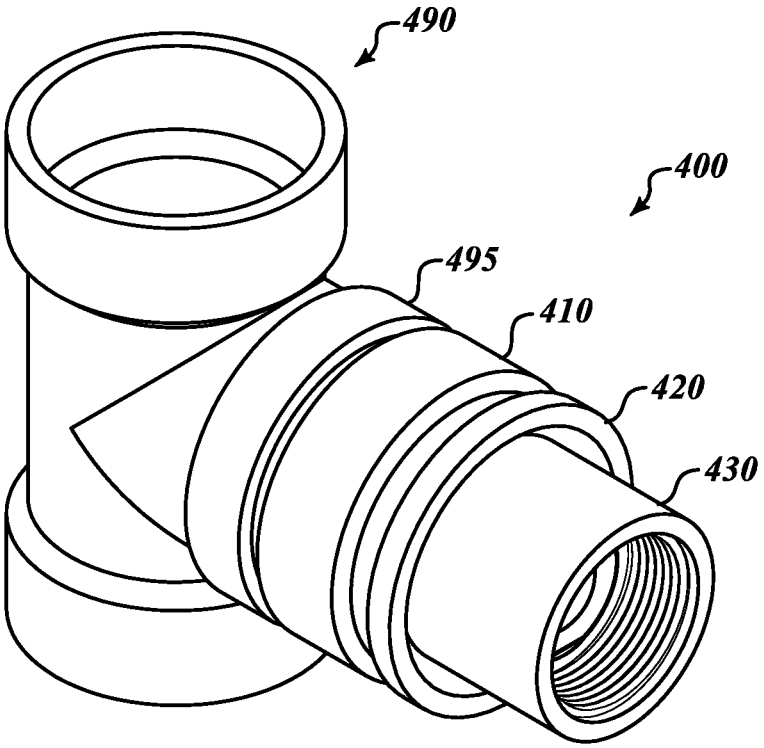
FIG. 7 is an isometric view of an embodiment of a cleanout jetting device.
Figure 8A:
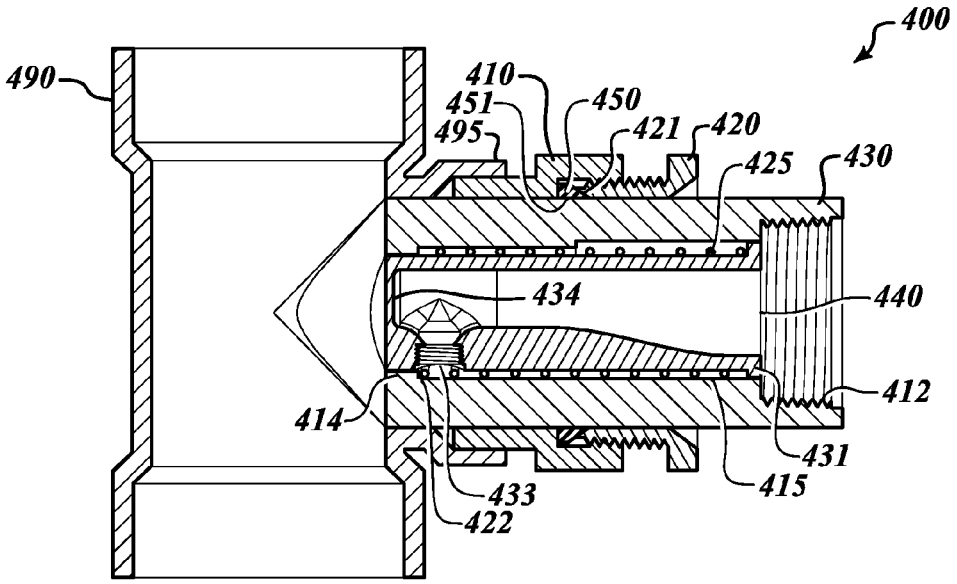
FIG. 8A is a cross-sectional view of the cleanout jetting device of FIG. 7 in a retracted position.
Figure 8B:
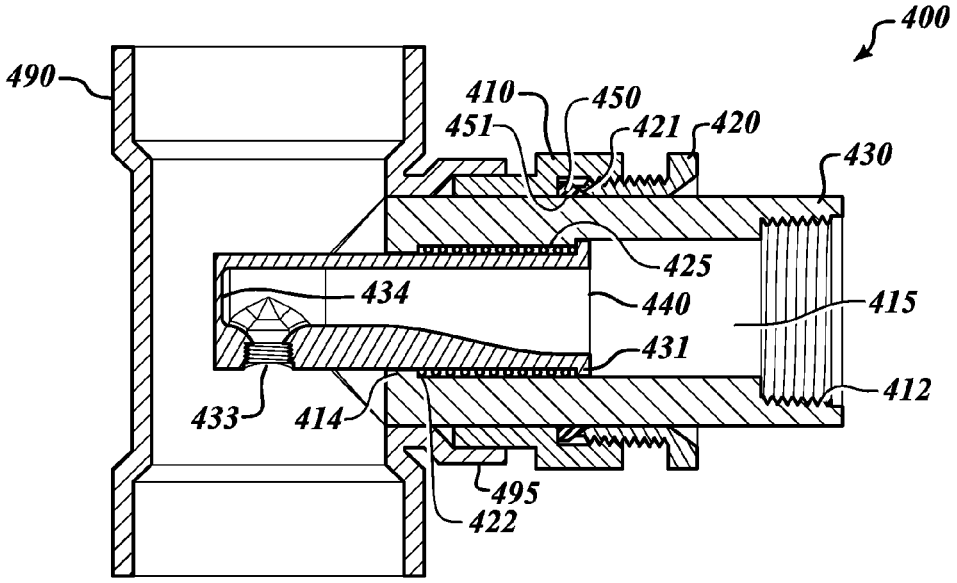
FIG. 8B is a cross-sectional view of the cleanout jetting device of FIG. 7 in an extended position.

FIG. 7 shows an embodiment of a clean-out jet. The illustrated clean-out jet 400 is configured for installation and use in a middle inlet 495 of a clean-out tee fitting 490. In some embodiments, the middle inlet of a cleanout tee may not have threads. In such embodiments, for example as shown in FIGS. 7, 8A, and 8B, an adapter 410 may be configured to facilitate installation of a jet 400 into the cleanout tee 490. An adapter 410 fits within the middle inlet 495. During installation, a plumber or installer may use a bonding agent to affix the adapter 410 to the middle inlet 495. In other embodiments, for example as shown in FIGS. 7, 8A, and 8B, friction and compression forces may hold the adapter 410 in place.

To mount the jet to the tee, an installer places the adapter 410 into the middle inlet 495 of the tee 490. The installer will also insert the jet body 430 into the tee 490 and the adapter 410. The installer may also insert a slip-joint washer 450 and threaded slip joint ring 420 between the jet body 430 and the adapter 410. Then, the plumber or installer can screw the slip joint ring 420 into the adapter 410. This may force the angled surface 421 of the slip joint ring 420 and an angled surface 451 of the slip joint washer 450 into each other. By pushing the angled surfaces 451, 421 together, the adapter 410 expands causing friction and compression forces hold it in the inlet 495. The pushing also causes a second, opposite force inward against the jet body 430, which holds the body in place and resists rotation of the jet body 430. In this way, the jet 400 attaches to the tee 490.

The operation of and internal structure of the cleanout jet 400 is similar to that of the p-trap jet discussed above. FIG. 8A shows a cross section of the jet 400 of FIG. 7. As shown, the body 430 may include an interior cavity 415 that extends between a nozzle aperture 414 at a drain line end of the body 430 and an inlet 412 at a coupling location of the body 430. The inlet 412 may receive an adapter (not shown) for connecting to a plumbing system or water supply line. In some embodiments, the coupling location may include threads to directly couple to a water supply line (not shown). In some embodiments, a water supply coupling (not shown) may retain a nozzle 440 within the interior cavity 415 of the jet 400 by providing a surface against which a nozzle flange 431 may rest.

The interior cavity 415 may house a nozzle or nozzle body 440 and nozzle bias spring 425. The bias spring 425 coils around the nozzle body 440. A first end of the spring pushes against the jet body 430 at a spring shoulder 422 and a second end of the spring pushes against a nozzle flange 431. In this way, the spring 425 acts to keep the nozzle body 440 in a retracted position when the jet 400 is off.

When the jet 400 is on, water pressure acts against the end of a nozzle 434. The water pressure against the end 434 overcomes the bias force of the spring 425 and causes the nozzle to pass through the jet aperture 414 and enter the tee 490 as shown in FIG. 8B. When the nozzle body 440 is in the extended or jetting position as shown in FIG. 8B, a nozzle 433 is exposed to the interior of the tee 490 and oriented in the tee's 490 direction of flow. With the nozzle 433 exposed, the water and/or other jetting fluid is expelled from the nozzle and acts to clear the tee 490 and downstream pipes of debris by forcing the debris further down the drain line.

Although the jet 400 of FIGS. 8A and 8B is shown to have a single nozzle 433, in some embodiments a jet may have multiple nozzles.

Figure 9:
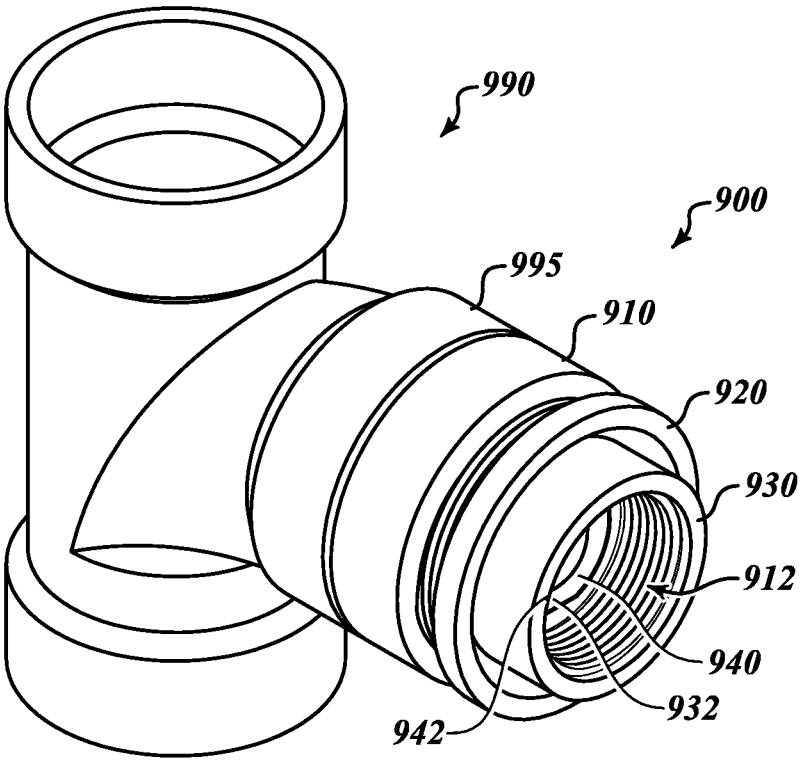
FIG. 9 is an isometric view of an embodiment of a sanitary cleanout jetting device.
Figure 10A:
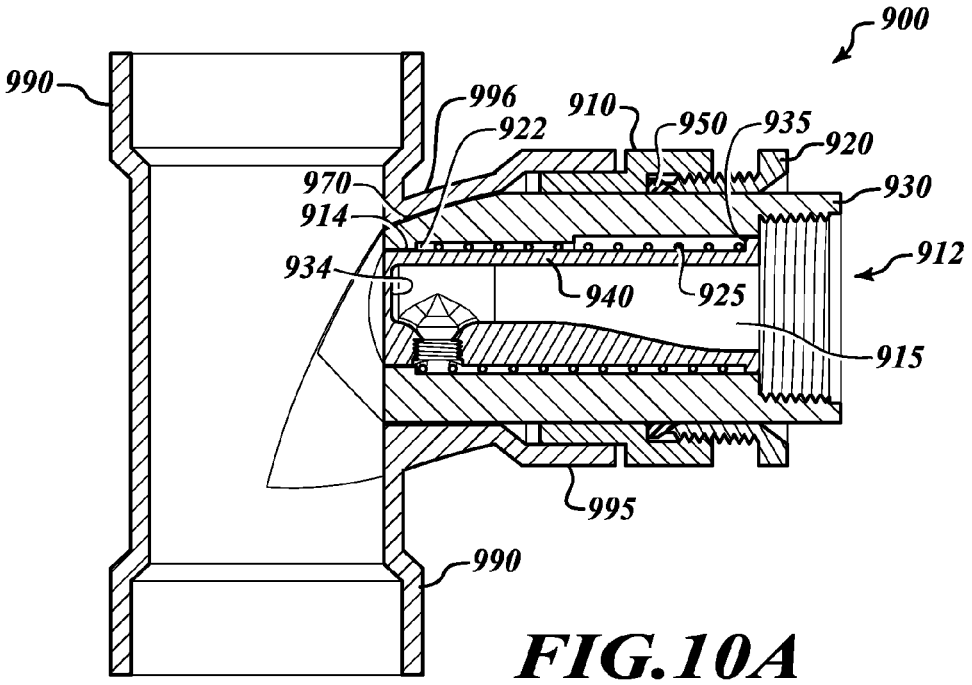
FIG. 10A is a cross-sectional view of the sanitary cleanout jetting device of FIG. 9 in a retracted position.
Figure 10B:
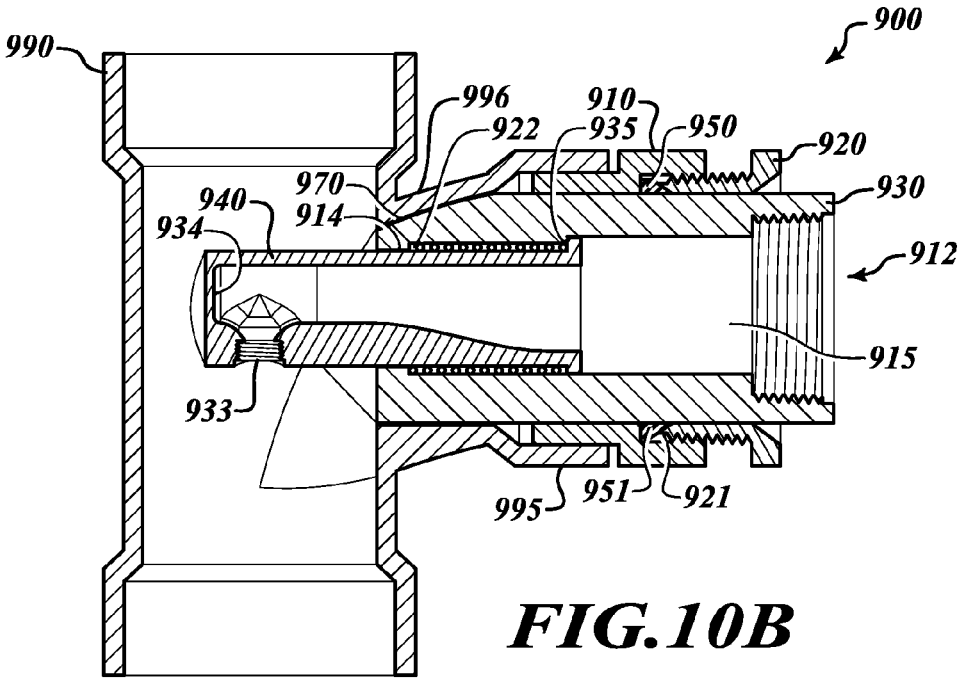
FIG. 10B is a cross-sectional view of the sanitary cleanout jetting device of FIG. 9 in an extended position.

FIGS. 9, 10A, and 10B show an embodiment of a sanitary clean-out jet. A sanitary clean-out jet 900 is configured for installation and use in middle inlet 995 of a sanitary clean-out tee fitting 990. Whereas a standard tee fitting has a middle inlet that joins with the main body of the tee at a right angle, the middle inlet of a sanitary cleanout usually includes a surface that curves in the direction of flow for the tee. The curve helps guide fluid and debris flowing through a sanitary tee in a particular direction. For example, the middle inlet 995 of the sanitary cleanout tee 990 includes an angled surface 996 that guides debris and fluid through the inlet in the direction of flow for the sanitary tee. Therefore, a sanitary tee jet body 930 can include a complementary curved surface section 970 that matches the angled surface 996 of the sanitary cleanout tee 990.

In some embodiments, the middle inlet 995 of a sanitary cleanout tee 990 may not be threaded. In such embodiments, for example as shown in FIGS. 9, 10A, and 10B, an adapter 910 may be configured to facilitate installation of a jet 900 into the sanitary cleanout tee 990. The adapter 910 fits within the middle inlet 995. During installation, a plumber or installer may use a bonding agent to affix the adapter to the middle inlet 995. In other embodiments, for example as shown in FIGS. 9, 10A, and 10B, friction and compression forces may hold the adapter 910 in place.

To mount the jet to the tee, an installer places the adapter 910 into the middle inlet 995 of the tee 990. The installer may also insert the jet body 930 into the tee 990 and the adapter 910. The installer will also insert a slip-joint washer 950 and threaded slip joint ring 920 between the jet body 930 and the adapter 910. Then, the plumber or installer can screw the slip joint ring 920 into the adapter 910. This may force angled surface 921 of the slip joint ring 920 and angled surface 951 of the slip joint washer 950 into each other. By pushing the angled surfaces 951, 921 together, the adapter 910 expands causing friction and compression forces to hold it in the inlet 995. The pushing also causes a second, opposite force inward against the jet body 930, which holds the body in place and resists rotation of the jet body 930. In this way, the jet 900 attaches to the tee.

A nozzle body 940 and jet body 930 may also include indexing structures that help prevent the nozzle body 940 from rotating with respect to the jet body 930. The structures help keep the nozzle 933 aligned with the direction of flow in the drains. The nozzle body 940 may include an indexing surface 942, such as a flat surface, that corresponds to a matching indexing surface 932 of the jet body. The matched surfaces help ensure that that the nozzle body 940 does not rotate within the jet body 930 and that the nozzle is pointed in the desired direction within the drain or tee 990. Although discussed with respect to the sanitary tee jet 900, an alignment structure may be used on any jet.

The operation and internal structure of the cleanout jet 900 is similar to that of the p-trap and clean out jets discussed above. FIG. 10A shows a cross section of the jet 900 of FIG. 9. As shown, the body 930 may include an interior cavity 915 that extends between a nozzle aperture 914 at a drain line end of the body 930 and an inlet 912 at a coupling location of the body 930. The inlet 912 may receive an adapter (not shown) for connecting to a plumbing system or water supply line. In some embodiments, the coupling location may include threads to directly couple to a water supply line (not shown). In some embodiments, a water supply coupling (not shown) may retain the nozzle 940 within the interior cavity 915 of the jet 900 by providing a surface against which a nozzle flange 935 may rest.

The interior cavity 915 may house a nozzle or nozzle body 940 and nozzle bias spring 925. The bias spring 925 coils around the nozzle body 940. A first end of the spring pushes against the jet body 930 at a spring shoulder 922 and a second end of the spring pushes against the nozzle body flange 935. In this way, the spring 925 acts to keep the nozzle body 940 in a retracted position when the jet 900 is off.

When the jet 900 is on, water pressure acts against an end of the nozzle 934. The water pressure against the end 934 overcomes the bias force of the spring 925 and causes the nozzle to pass through the nozzle aperture 914 and into interior of the tee 990 as shown in FIG. 8B. When the nozzle body 930 is in the extended or jetting position as shown in FIG. 8B, a nozzle jet 933 is exposed to the interior of the tee 990 and oriented in the tee's 990 direction of flow. With the nozzle jet 933 exposed, the water and/or other jetting fluid is expelled from the nozzle and acts to clear the tee 990 and downstream pipes of debris by forcing the debris further down the drain line.

Figure 11:
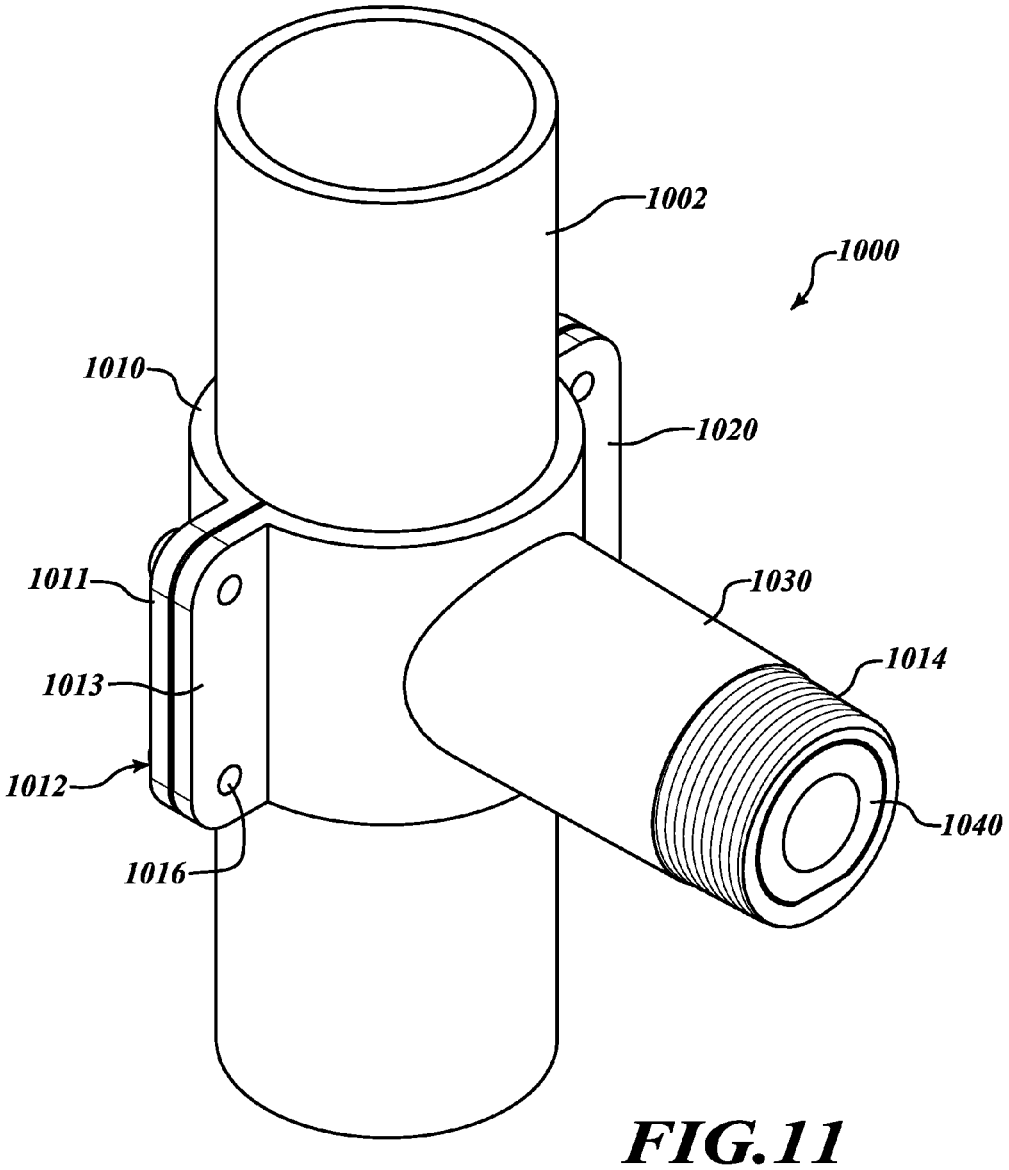
FIG. 11 is an isometric view of an embodiment of a jetting device.

In some plumbing systems, easy to access and removable pipefittings are unavailable. In such circumstances, a facility may install a clamp on jet. FIG. 11 shows an embodiment of a clamp on jet in the form of clamp on jet 1000. The clamp on jet 1000 includes many of the features and elements of the other jets disclosed herein. The jet 1000 includes a jet body 1030 and nozzle body 1040. The jet body 1030 may include a first clamping structure, for example, extension or base 1020 that extends at least partially around drain line 1002. The extension 1020 may include a flange 1013 that is configured to mate with a corresponding flange 1011 of a second clamping structure 1010. The first and second structures may include surfaces that conform to the surface of a drain line. The flanges 1011, 1013 may be coupled together to clamp the jet 1000 to the drain line 1002. In some embodiments the flanges 1011, 1013 may include bolt holes such as flange bolt holes 1012, 1016 that couple the flanges 1011, 1013 together and hold the jet 1000 on the drain line 1002.

Figure 12:
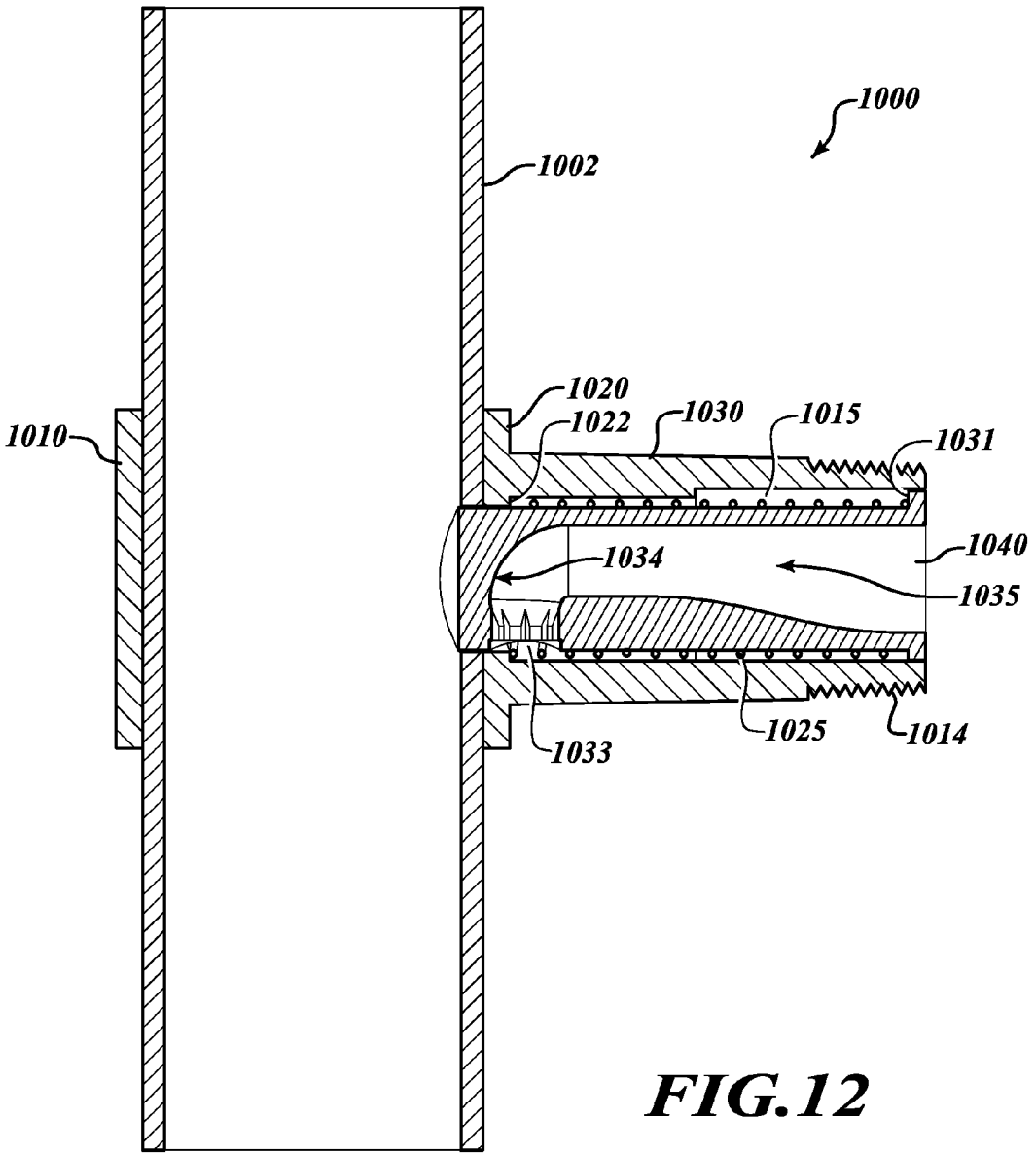
FIG. 12 is a cross-sectional view of the jetting device of FIG. 11.

FIG. 12 shows a cross-sectional view of the clamp on jet 1000 of FIG. 11. A nozzle body 1040 may slidingly fit within an interior cavity 1015 of the jet body 1030. As with the p-trap jet, the nozzle body 1040 may be spring biased in a retracted position by spring 1025 that is captured by a spring shoulder 1022 of the interior cavity 1015 and a flange 1031 of the nozzle body 1040. The nozzle body 1040 may include a nozzle 1033 for expelling liquid into the drain line 1002 and a nozzle cavity 1035 in fluid communication with the nozzle 1033 and a supply line (not shown). A supply line may connect to the jet body via a jet inlet coupling, for example the jet inlet coupling 1014.

Similar to the p-trap jet, when pressurized fluid enters the jet 1000, the pressure from the fluid acts against an end 1034 of the nozzle body 1040, which causes the nozzle body 1040 to extend into the drain line 1002 and expel the pressurized fluid out the nozzle 1033 to clean and wash debris down the drain.

Figure 13:
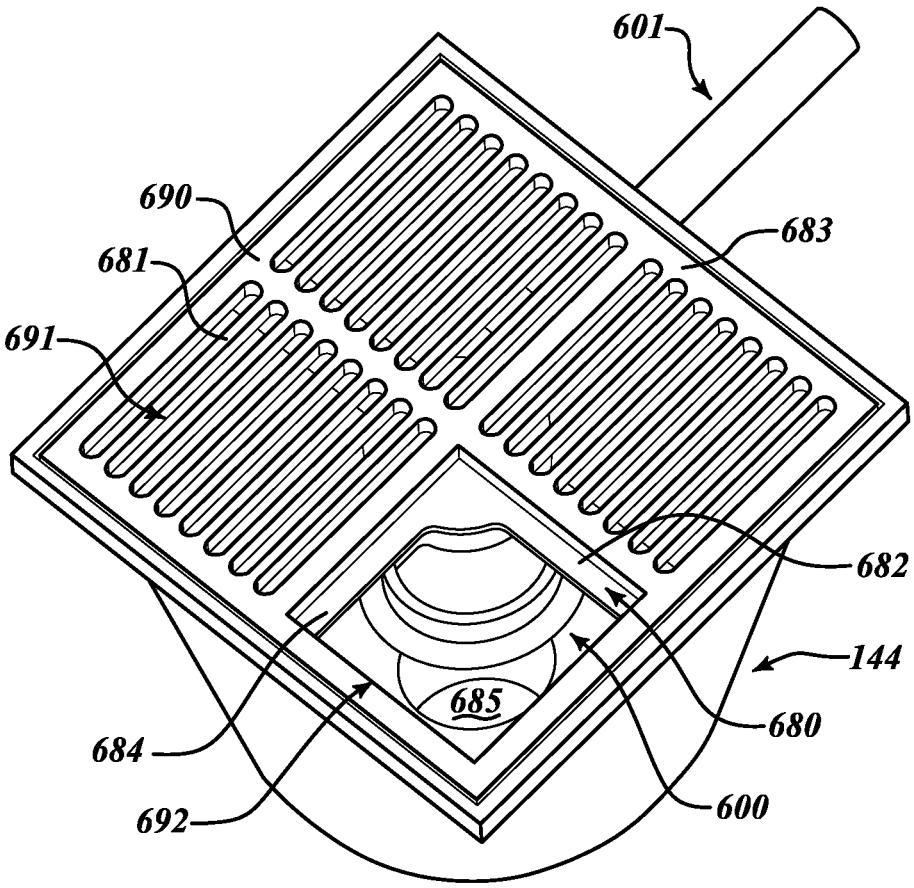
FIG. 13 is top perspective view of an embodiment of a floor sink jetting device.
Figure 14A:
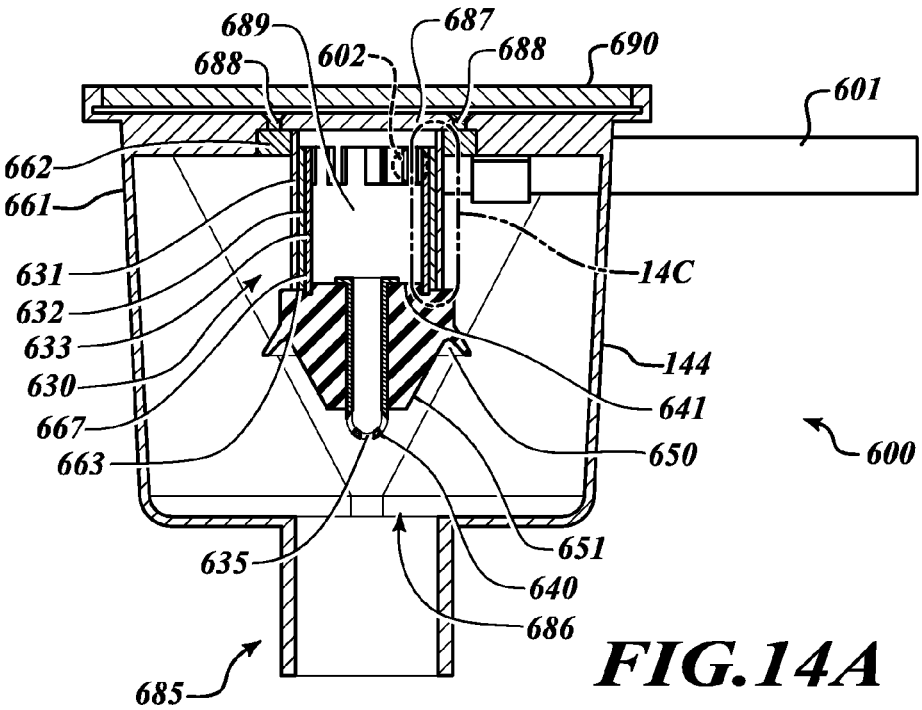
FIG. 14A is a cross-sectional view of the floor sink jetting device of FIG. 7 in a retracted position.
Figure 14B:
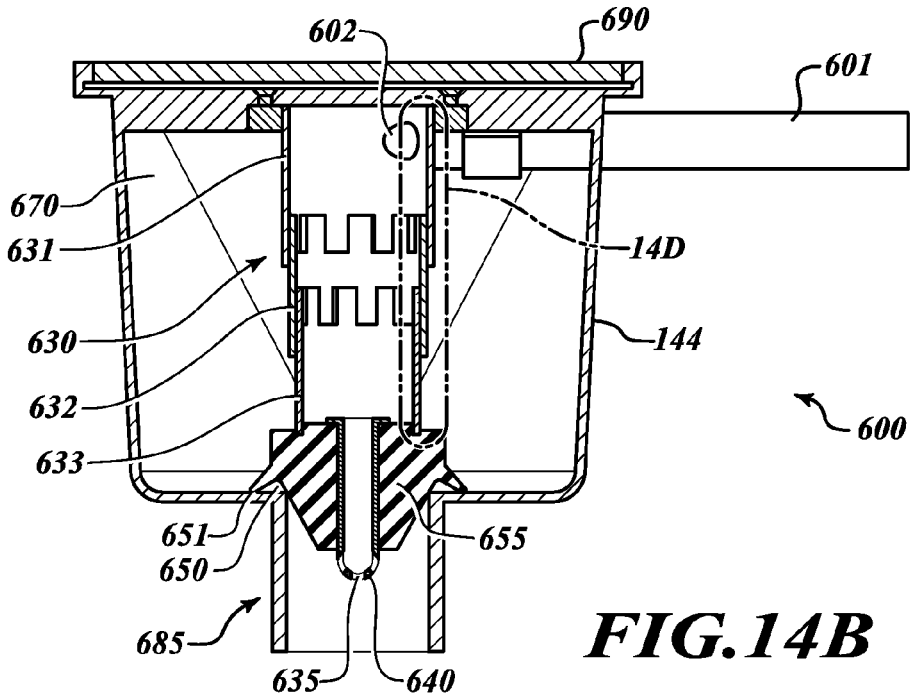
FIG. 14B is a cross-sectional view of the floor sink jetting device of FIG. 7 in an operating or jetting position.

FIGS. 13, 14A, and 14B show an embodiment of a floor sink jet 600 installed in a floor sink 144. A floor sink is a type of sink that is typically mounted in a floor with its rim flush with the surface of the floor. A floor sink provides a large space for collecting and draining fluids that may contain debris and other contaminants. The floor sink 144 may include a sink cover 690. The sink cover 690 may include a grate portion 691 for preventing large debris from entering the sink 144 and it may also include an opening 692 that allows large drain pipes to be placed inside the floor sink 144. Like a counter sink, a floor sink will also have a drain, such as drain 685. The drain 685 may connect to a wastewater or effluent system.

In some embodiments of a floor sink jet, the floor sink jet 600 may be mounted to the floor sink 144 via a mounting frame or housing bracket 680. The mounting frame 680 may include opposing mounting arms 681, 682, 683, 684, for mounting the frame 680 to the floor sink 144. Screws 688 may couple the floor sink jet 600 to the mounting frame 680. In some embodiments, the mounting frame holds the floor sink jet 600 over the drain 685 of the floor sink 144. In some embodiments, the floor sink jet 600 may be mounted directly to the sink cover 690, which may also act as a mounting frame or housing bracket.

Figure 14C:
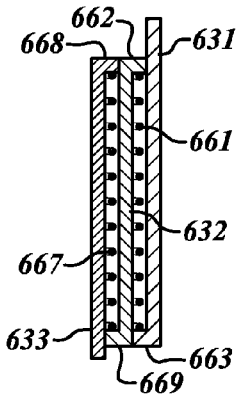
FIG. 14C is a detail view of the telescoping mechanism of FIG. 14A.

FIG. 14A shows a cross-sectional view of a floor sink jet 600 installed in a floor sink 144 with the jet 600 in a retracted or stagnant position. FIG. 14C shows a detailed view of the telescoping mechanism of the floor sink jet 600. Jetting fluid enters the internal cavity 689 of jet body 630 through a floor sink jet inlet 602 via supply line 601. The internal cavity 689 may extend from a base 687 to a jet head 655. The jet body 630 may be a telescoping body comprised of one or more telescoping segments. For example, the illustrated jet body 630 includes one stationary segment 631 and two telescoping segments 632, 633. As shown in FIGS. 14A-14D, each telescoping segment 632, 633 may nest inside another segment. In some embodiments, the telescoping segments surround other segments.

Bias springs 661, 667 apply a force to keep the telescoping segments 632, 633 in a retracted position when the jet is off, as shown in FIGS. 14A and 14C. A first bias spring 661 applies a force against an upper flange 662 of a first telescoping segment 632 and a lower flange 663 of a stationary segment 631. A second bias spring 667 applies a force against an upper flange 668 of a second telescoping segment 633 and a lower flange 669 of the first telescoping segment 632.

The bias springs disclosed herein may have a spring constant chosen such that the bias springs hold nozzle body or telescoping segments in a substantially retracted position when the jet is off and allows the nozzle body or telescoping segments to move to an extended position when the jet is on and the internal cavity is pressurized.

In the embodiments shown in FIGS. 14A-14D, the bias springs push against flanges to retract the telescoping segments. In some embodiments, a bias spring may pull against the nozzle components to hold the nozzle in a retracted position. For example, a spring may have a first end coupled to a top or fixed portion of a nozzle body and a second end coupled to a bottom portion of a nozzle body, nozzle head, or movable portion. The spring may then pull the movable portion towards the stationary portion to retract the nozzle.

Figure 14D:
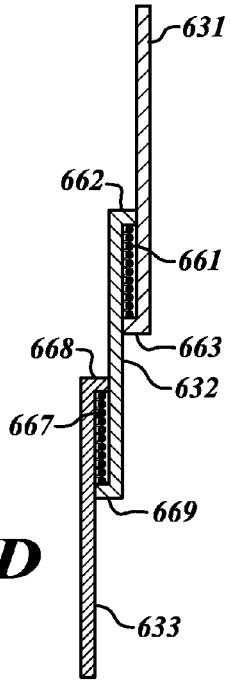
FIG. 14D is a detail view of the telescoping mechanism of FIG. 14B.

In a retracted position, the bias springs of jet 600 hold nozzle body 640 and drain sealing surfaces 650, 651 away from the drain opening 686. This arrangement allows the sink 144 to drain during normal everyday use. When the jet is on, the water pressure against surface 641 overcomes the bias force of the bias springs 661, 667, causing the telescoping segments to extend down towards a drain opening 686 as shown in FIG. 14B. FIG. 14D shows a detailed view of the telescoping mechanism of the floor sink jet 600 in an extended position.

In an extended position one or more drain sealing surfaces 650, 651, form a seal around a drain opening 686. In the embodiment shown in FIG. 14B, two seals prevent fluid from flowing from the drain 685 back into the sink 144 and from the sink 144 into the drain 685. The first sealing surface 651 contacts an inner rim of the drain opening 686 and creates a first seal. The first sealing surface may be conically shaped. The second sealing surface 650 may create a second seal with the floor of sink 144. The second sealing surface 650 may extend radially from a perimeter of telescoping jet head 655. In some embodiments, only one of the first and second sealing surfaces may be used to create a single seal. The drain sealing surfaces 650, 651 may also be referred to as splash guards. In some embodiments, the seals may be comprised of rubber.

When the jet 600 is activated and the nozzle body extends into the drain 685, the nozzle body 640 is positioned such that the nozzle orifice 635 can send water directly down the drain 685 and clean and clear the drain 685 of debris.

Figure 16:
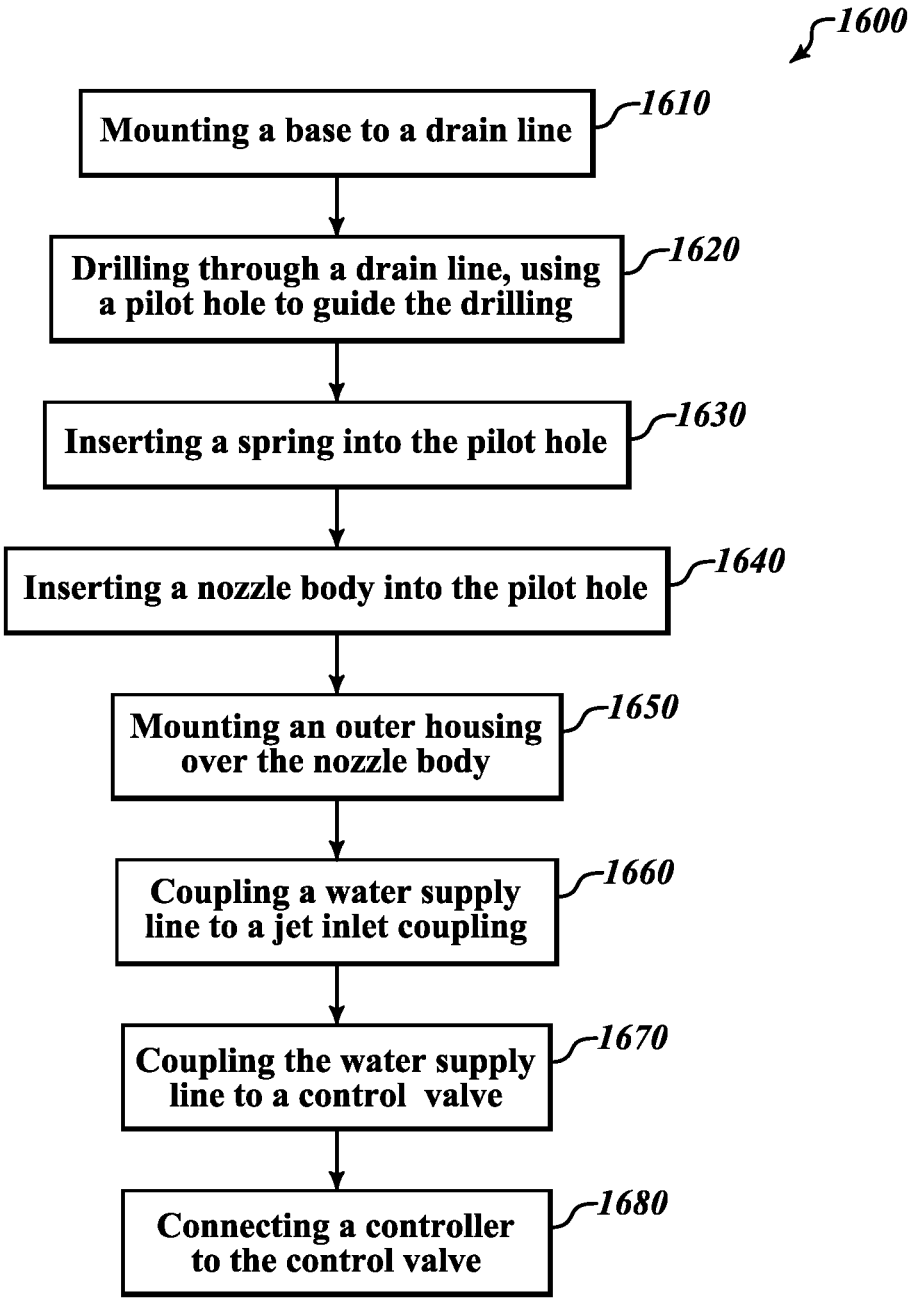
FIG. 16 is a flow chart showing an embodiment of a method of installing a drain jet.

FIG. 16 depicts an embodiment of a method of installing a drain jet 1600. The method is applicable to both retrofit and new installations. In step 1610, a base is mounted to a drain line. In some embodiments, step 1610 may also include mounting a main body to a drain line. The drain line may be a pipe made of PVC or other plastic or metal pipes. The drain line may be oriented in a horizontal or vertical orientation, or it may be in any other orientation. In some embodiments, the base may be mounted to a drain line above or upstream of a p-trap, while in other embodiments, the base may be mounted downstream of a p-trap. In still other embodiments, the base may be mounted, and a jet installed, in any location in a drain system where it may be effective in preventing clogs. In still other embodiments, a mounting a base may not be necessary.

In step 1620, an installer drills a hole through a drain line using a pilot hole to guide the drilling. In some embodiments, the installer may use a cavity of a jet body to guide the drilling or the installer may use another type of fixture to guide the drilling. In some embodiments, the installer may drill a hole in a drain line without using a pilot hole or any other fixture to guide the process.

Step 1630 includes inserting a spring into the pilot hole. The spring may be a bias spring as described above. In some embodiments, the spring is mounted on the nozzle body before being inserted into the pilot hole. In some embodiments, the spring is inserted into the pilot hole or cavity during the manufacturing process and therefore it is already in the hole or cavity when the jet body or base is mounted to the drain line.

Step 1640 includes inserting a nozzle body into the pilot hole. In some embodiments, an installer may insert the nozzle body into the cavity of a jet body. In some embodiments, the nozzle body is inserted into the pilot hole or cavity during the manufacturing process and therefore it is already in the hole or cavity when the jet body or base is mounted to the drain line.

Step 1650 includes mounting an outer housing over the nozzle body. In some embodiments, an outer housing may not be necessary, in such embodiments, an installer may omit step 1650. In some embodiments, a housing may consist of more than one piece, therefore, in some embodiments, mounting an outer housing may include coupling a first piece or half of a housing to a second piece or half of a housing.

Step 1660 includes coupling a water supply line to a jet inlet coupling. This step may include the step of coupling the jet to a water supply system. In some embodiments, this step may include coupling a water supply line to a coupling location of a jet's body or housing.

Step 1670 includes coupling a water supply line to a control valve. As discussed earlier, a control valve may be a solenoid valve, a motorized valve, a pneumatic valve, or other type of control valve. In some embodiments, the control valve may be a manually operated valve.

Step 1680 includes connecting a controller to the control valve. The controller may be a control system such as controller 150 of FIGS. 1 and 15. In some embodiments the controls system may be a PLC in electronic communication with the control valve.

The steps of method 1600 may be carried out in any practical order and some steps may be omitted or duplicated.

Figure 17:
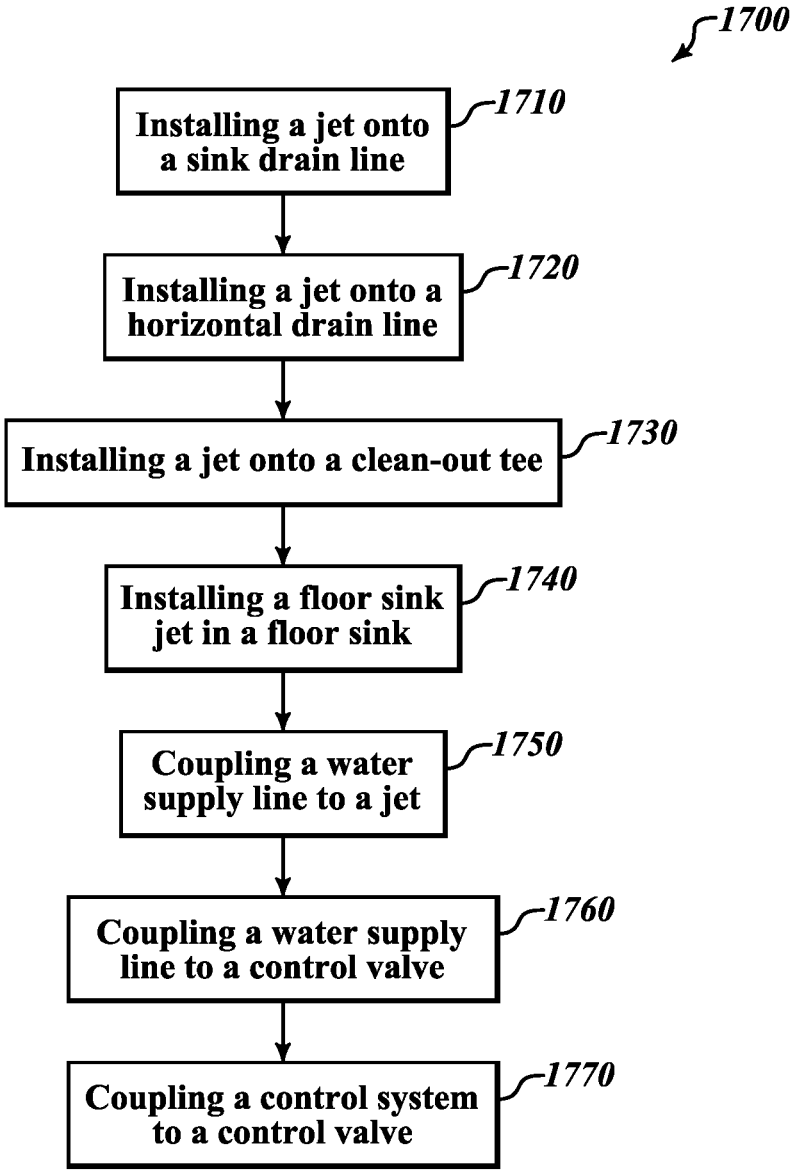
FIG. 17 is a flow chart showing an embodiment of a method of installing a jet system.

FIG. 17 depicts an embodiment of a method 1700 of installing a drain jetting system. The method 1700 is applicable to both retrofit and new installations. Step 1710 includes installing a drain jet onto a sink drain line. In some embodiments, step 1710 may include the step of installing the jet onto a drain line upstream of a p-trap or on a vertical drain line upstream of a p-trap. The drain line may be a counter sink drain line, a floor sink drain line, or any other type of drain line.

Step 1720 may include installing a jet onto a horizontal drain line. In some embodiments the horizontal drain line may be downstream of a p-trap.

Step 1730 may include installing a jet into a clean-out tee. The clean-out tee may be a sanitary cleanout out tee or a standard clean out tee. In some embodiments, step 1730 may also include the step of installing a jet onto a vent line.

Step 1740 may include installing a floor sink jet in a floor sink. In some embodiments step 1740 may include mounting a jet to a mounting frame and mounting the mounting frame to a floor sink.

The jet installation steps may also include any of the steps for installing a jet, for example as described above with respect to FIG. 16.

Step 1750 may include the step of coupling a water supply line to a jet. Step 1750 may also include coupling a water supply line to a plurality of jets in a water jetting system. In some embodiments, this step includes coupling a water supply line to a pipe fitting adapter of a jet, an inlet of a jet, or a coupling location of a jet.

Step 1760 may include the step of coupling the water supply line to a control valve. The control valve may be a solenoid valve, a motorized valve, a pneumatic valve, or other control valve. The control valve may be a manually operated control valve. Step 1760 may include the step of coupling the control valve to a manifold and the manifold to a water supply system. Step 1760 may also include coupling the a water supply line to an expansion tank.

Step 1770 may include coupling a control system to a control valve. In some embodiments, step 1770 may include coupling the control system in electronic communication with the control valve.

Figure 18:
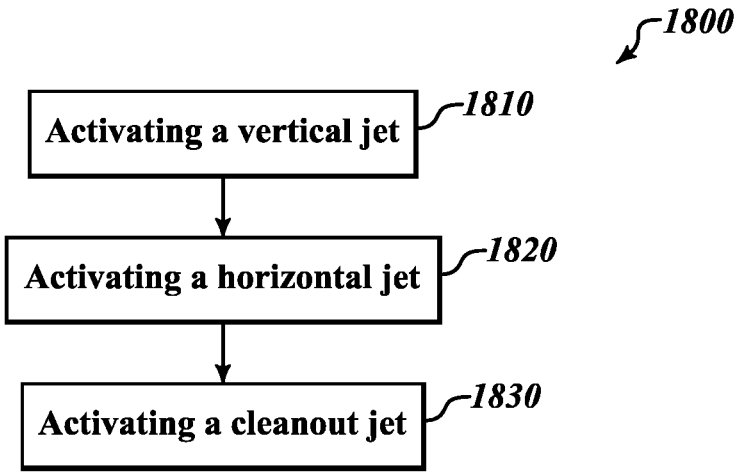
FIG. 18 is a flow chart showing an embodiment of a method of jetting a counter sink drain.

FIG. 18 shows one embodiment of a method of jetting a counter sink drain 1800. Step 1810 includes activating a vertical jet. Step 1810 may include jetting water into the drain line from a vertical jet for a predetermined period of time. Step 1810 may include activating, or turning on, a jet installed upstream of a p-trap that clears the p-trap for a predetermined period of time.

Step 1820 includes activating a horizontal drain jet. Step 1820 may include jetting water into the drain line from a horizontal drain jet for a predetermined period of time. Step 1820 may include activating, or turning on, a jet installed downstream of a p-trap that clears the drain line for a predetermined period of time. The horizontal drain jet may be mounted downstream of a p-trap or upstream of a vent line or a main drain line.

Step 1830 includes activating a clean-out drain jet. Step 1830 may include jetting water into a main drain line from a clean-out drain jet for a predetermined period of time. Step 1830 may include activating, or turning on, a jet installed downstream of a p-trap that clears a vent line or other drain line for a predetermined period of time. The clean-out jet may be mounted in a tee fitting downstream of a p-trap, on a vent line, or upstream of a main drain line.

The predetermined period of time may be 1 second, 5 seconds, 10 seconds, 20 seconds, between about 1 and about 10 seconds, between about 10 and about 20 seconds, or about 1 minute.

The system may carry out the method of jetting a first counter sink drain line and then proceed by jetting out another drain line, such as a second counter sink drain line or, for example, a floor sink drain line. In some embodiments, the system may jet a vertical jet of a first counter sink drain followed by a vertical jet of a second counter sink drain, followed by a horizontal jet of the first counter sink drain, and on.

Figure 19:
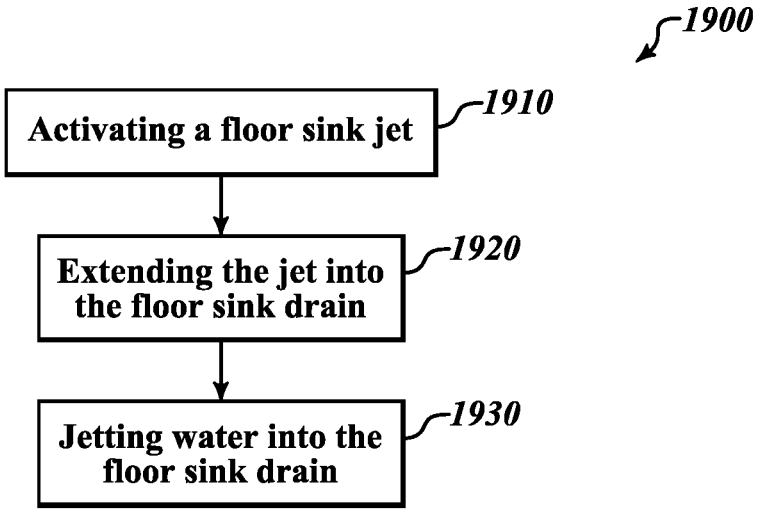
FIG. 19 is a flow chart showing an embodiment of a method of jetting a floor sink drain.

FIG. 19 shows a method of jetting a floor sink drain 1900. Step 1910 includes activating a floor sink jet. Activating a floor sink jet may include providing pressurized water to the jet. Step 1920 includes extending the floor sink jet head into the floor sink drain. In some embodiments, step 1920 may include extending the floor sink jet head towards the floor sink drain. Step 1930 includes jetting or flushing water through the floor sink jet to clean or flush debris through a p-trap and into a main drain line for a predetermined period of time.

In some embodiments, for example embodiments of a floor sink jet system that includes additional jets, the additional jets may be activated, for example, as described with respect to the counter sink jetting method shown and described with respect to FIG. 18.

In some embodiments, the jets may be coupled to a hot water supply system or hot water heater or to a degreaser or cleaning solution supply system. By using hot water, degreaser, or a cleaning solution mixed with water, a jetting system may more effectively purge the drain lines of coffee grounds, grease, and other debris.

In some methods of jetting a wastewater system, the control system may activate all the floor sink drains, clean-out drains, and drain line drains for a predetermined period of time, for example, one minute, at or after closing to conduct a nightly purge of the wastewater system. Such a process, and indeed, all the methods and process described for activating a jet or jetting system may be carried out by an appropriately configured control system.

A controller or control system may be configured to jet a counter sink or other drain sink at regular intervals throughout the day, for example every 3 to 4 hours, or at predetermined times during the day, for example after lunch and at or after closing. A control system may also be configured to delay jetting, for example on weekends or holidays when a facility may not be in use.

In some embodiments, the controller may be configured to activate a jetting process when an operator presses an activation button. For example, if an operator notices that a particular drain starts to drain water slowly, this may be a sign that a clog is starting to form. In such a situation, an operator may want to run the jetting system proactively to clear the drain line before a clog forms.

A controller may also be configured to jet or spray at various durations, for example, at one of the predetermined times described above. A controller may also active different jets for differing lengths of time.

A control system may also include overflow protection. For example, an overflow sensor 115 may be installed on a sink overflow drain to detect a clog, see FIG. 2. If a clog is detected, the controller may deactivate the jetting system to prevent adding additional water to an already clogged and full drain system.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system for clearing a wastewater system of debris, the system comprising:

a first drain line jet configured to be mounted to a horizontal drain line, the first drain line jet including a body with an internal cavity extending between a first nozzle aperture and an inlet;

a first water supply line coupled to a first control valve and the first drain line jet such that the first control valve is in fluid communication with the first drain line jet;

a system controller in electrical communication with the first control valve and configured to activate the first control valve for a predetermined period of time; and the first nozzle aperture configured to expel fluid in a direction of flow of the drain line.

2. The system of claim 1 further comprising:

a second drain line jet configured to be mounted to a vertical drain line, the vertical drain line jet including a body with an internal cavity extending between a second nozzle aperture and an inlet;

a second water supply line coupled to the control valve and the first drain line jet such that the second control valve is in fluid communication with the second drain line jet;

the system controller in electrical communication with the second control valve and configured to activate the second control valve for a predetermined period of time; and the second nozzle aperture configured to expel fluid in a direction of flow of the vertical drain line.

3. The system of claim 2 wherein the first drain line jet is mounted to a drain line upstream of a p-trap and the second drain line jet mounted to a drain line downstream of a p-trap.

4. The system of claim 3 further comprising:

a third body with an internal cavity extending between a third nozzle aperture and an inlet, the third body including a base configured to couple the third body to a drain line;

an adapter, a slip joint ring, and a slip joint washer, each of which at least partially surrounding an external circumference of the third body;

the adapter configured to engage an inlet of a tee pipe fitting and the slip joint slip joint washer and slip joint ring configured to engage with the adapter and the exterior of the third nozzle body; and the adapter, the slip joint ring, and the slip joint washer configured such that engaging the slip joint ring with the adapter retains the device in the tee pipe fitting;

a third nozzle body disposed within the internal cavity; and a bias spring configured to retain the third nozzle body in a retracted position;

the third nozzle body configured to extend into the drain line when the third nozzle body is pressurized; and the third nozzle body including a third nozzle configured to expel fluid in a direction of flow of the drain line.

* * * * *